US012628914B2

(12) United States Patent
Sakiyama et al.

(10) Patent No.: US 12,628,914 B2
(45) Date of Patent: May 19, 2026

(54) SOCK LINER DESIGNING APPARATUS, SOCK LINER DESIGNING METHOD AND RECORDING MEDIUM FOR RECORDING PROGRAM

(71) Applicant: ASICS CORPORATION, Kobe (JP)

(72) Inventors: Ryota Sakiyama, Kobe (JP); Genki Hatano, Kobe (JP); Shingo Takashima, Kobe (JP); Toshiaki Okamoto, Kobe (JP); Hiroyuki Kusumi, Kobe (JP)

(73) Assignee: ASICS CORPORATION, Kobe (JP)

( * ) Notice: Subject to any disclaimer, the term of this patent is extended or adjusted under 35 U.S.C. 154(b) by 400 days.

(21) Appl. No.: 18/455,160

(22) Filed: Aug. 24, 2023

(65) Prior Publication Data

US 2024/0065385 A1 Feb. 29, 2024

(30) Foreign Application Priority Data

Aug. 26, 2022 (JP) ..... 2022-134793

(51) Int. Cl.
*A43D 1/02* (2006.01)
*A43B 17/00* (2006.01)
*A43D 119/00* (2006.01)

(52) U.S. Cl.
CPC ..... *A43D 1/02* (2013.01); *A43D 119/00* (2013.01); *A43B 17/00* (2013.01); *A43D 2200/60* (2013.01)

(58) Field of Classification Search
CPC .. A43D 119/00; A43D 2200/60; A43D 1/025; A43D 1/02; A43B 17/023; A43B 17/00
USPC ..... 33/515, 3 R; 73/172; 382/154; 356/608; 12/146 B
See application file for complete search history.

(56) References Cited

U.S. PATENT DOCUMENTS 10,206,456 B2 * 2/2019 Kohatsu ..... A43D 1/02
10,264,853 B2 * 4/2019 Arayama ..... A43B 7/141
10,482,214 B2 * 11/2019 Cluckers ..... B33Y 80/00
(Continued)

FOREIGN PATENT DOCUMENTS

WO 2017/057388 A1 4/2017

OTHER PUBLICATIONS

The extended European search report issued by the European Patent Office on Jan. 16, 2024, which corresponds to European Patent Application No. 23188040.2-1015 and is related to U.S. Appl. No. 18/455,160.

*Primary Examiner* — Peter J Macchiarolo
*Assistant Examiner* — Anna Josephine Saunders
(74) *Attorney, Agent, or Firm* — Studebaker Brackett PLLC

(57) ABSTRACT

A sock liner designing apparatus, a sock liner designing method and a recording medium for a recording program are provided that are used to design sock liners that enable functions of footwear desired by a user to be attained when the user wears the footwear. A sock liner designing apparatus includes: an input circuitry that receives an input of measured foot data; a processor that calculates design data of a sock liner based on the foot data received through the input circuitry; and an output circuitry that outputs the design data calculated by the processor. The processor adjusts the design data based on a difference between received footwear functions and footwear data.

10 Claims, 19 Drawing Sheets

(56) References Cited

U.S. PATENT DOCUMENTS

| | | | | |
|---|---|---|---|---|
| 11,758,984 | B1 * | 9/2023 | Kaddouri | G06Q 10/101<br>12/146 BP |
| 2015/0006119 | A1 * | 1/2015 | Arayama | A43B 7/141<br>703/1 |
| 2017/0068774 | A1 * | 3/2017 | Cluckers | A61B 5/743 |
| 2019/0116930 | A1 * | 4/2019 | Kohatsu | A43D 1/025 |
| 2020/0057837 | A1 * | 2/2020 | Cluckers | A61B 5/1036 |
| 2023/0248110 | A1 * | 8/2023 | Levine | B33Y 80/00<br>36/43 |
| 2024/0065385 | A1 * | 2/2024 | Sakiyama | A43D 1/02 |

* cited by examiner

FIG.10

| DESIRED FOOTWEAR FUNCTIONS | | | FOOTWEAR DATA | | | DIFFERENCE |
|---|---|---|---|---|---|---|
| CUSHIONING | n/a | | CUSHIONING | 5 | | n/a |
| STABILITY | 4 | | STABILITY | 3 | | 1 |
| GRIP | 4 | | GRIP | 3 | | 1 |
| FLEXIBILITY | n/a | | FLEXIBILITY | 4 | | n/a |
| FIT | n/a | | FIT | 3 | | n/a |
| DURABILITY | n/a | — | DURABILITY | 3 | = | n/a |
| VENTILATION | n/a | | VENTILATION | 5 | | n/a |
| LIGHT WEIGHT | 5 | | LIGHT WEIGHT | 4 | | 1 |
| RESILIENCE | n/a | | RESILIENCE | 3 | | n/a |
| SUPPORT AGAINST CUTTING MOVES | 5 | | SUPPORT AGAINST CUTTING MOVES | 2 | | 3 |
| ARCH SUPPORT | n/a | | ARCH SUPPORT | 2 | | n/a |

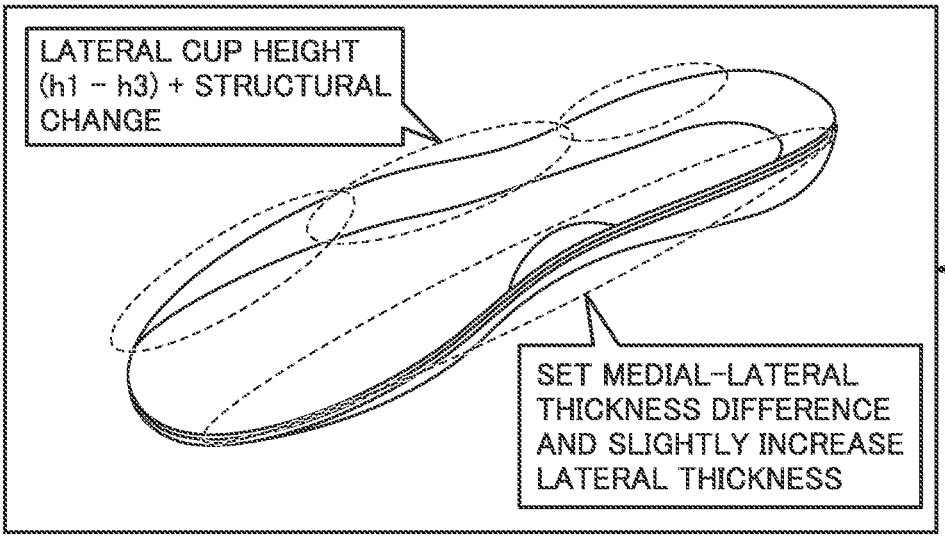

FIG.13

| DESIRED FOOTWEAR FUNCTIONS | | | FOOTWEAR DATA | | | DIFFERENCE |
|---|---|---|---|---|---|---|
| CUSHIONING | 4 | | CUSHIONING | 5 | | −1 |
| STABILITY | 5 | | STABILITY | 3 | | 2 |
| GRIP | n/a | | GRIP | 3 | | n/a |
| FLEXIBILITY | n/a | | FLEXIBILITY | 4 | | n/a |
| FIT | n/a | | FIT | 3 | | n/a |
| DURABILITY | n/a | — | DURABILITY | 3 | = | n/a |
| VENTILATION | n/a | | VENTILATION | 5 | | n/a |
| LIGHT WEIGHT | n/a | | LIGHT WEIGHT | 4 | | n/a |
| RESILIENCE | n/a | | RESILIENCE | 3 | | n/a |
| SUPPORT AGAINST CUTTING MOVES | n/a | | SUPPORT AGAINST CUTTING MOVES | 2 | | n/a |
| ARCH SUPPORT | 3 | | ARCH SUPPORT | 2 | | 1 |

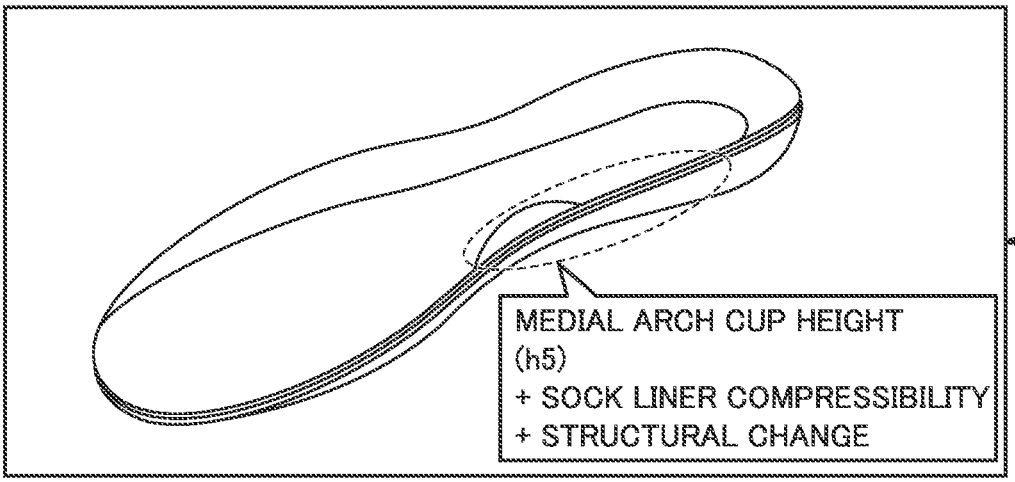

| DESIRED FOOTWEAR FUNCTIONS | | | FOOTWEAR DATA | | | DIFFERENCE |
|---|---|---|---|---|---|---|
| CUSHIONING | 4 | | CUSHIONING | 2 | | 2 |
| STABILITY | 3 | | STABILITY | 2 | | 1 |
| GRIP | 3 | | GRIP | 4 | | −1 |
| FLEXIBILITY | 4 | | FLEXIBILITY | 4 | | 0 |
| FIT | 3 | | FIT | 3 | | 0 |
| DURABILITY | 3 | − | DURABILITY | 2 | = | 1 |
| VENTILATION | 4 | | VENTILATION | 5 | | −1 |
| LIGHT WEIGHT | 3 | | LIGHT WEIGHT | 5 | | −2 |
| RESILIENCE | 3 | | RESILIENCE | 4 | | −1 |
| SUPPORT AGAINST CUTTING MOVES | n/a | | SUPPORT AGAINST CUTTING MOVES | n/a | | n/a |
| ARCH SUPPORT | 4 | | ARCH SUPPORT | 3 | | 1 |

FIG.15

| DESIRED FOOTWEAR FUNCTIONS | | | FOOTWEAR DATA | | | DIFFERENCE |
|---|---|---|---|---|---|---|
| CUSHIONING | 5 | | CUSHIONING | 4 | | 1 |
| STABILITY | 5 | | STABILITY | 3 | | 2 |
| GRIP | n/a | | GRIP | 3 | | n/a |
| FLEXIBILITY | n/a | | FLEXIBILITY | 4 | | n/a |
| FIT | n/a | | FIT | 3 | | n/a |
| DURABILITY | n/a | — | DURABILITY | 3 | = | n/a |
| VENTILATION | n/a | | VENTILATION | 4 | | n/a |
| LIGHT WEIGHT | n/a | | LIGHT WEIGHT | 3 | | n/a |
| RESILIENCE | n/a | | RESILIENCE | 3 | | n/a |
| SUPPORT AGAINST CUTTING MOVES | n/a | | SUPPORT AGAINST CUTTING MOVES | 2 | | n/a |
| ARCH SUPPORT | n/a | | ARCH SUPPORT | 4 | | n/a |

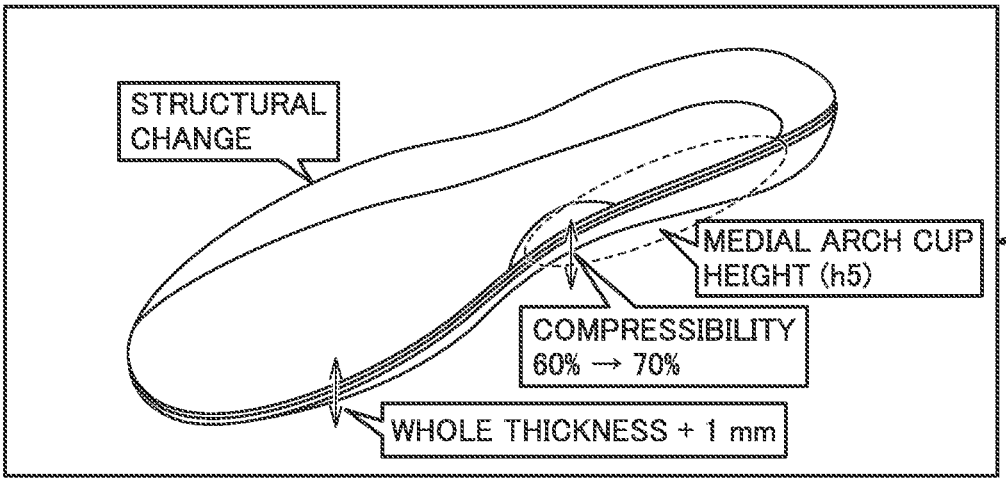

FIG.17

| LOADED FOOT SHAPE DATA (FIRST SAMPLE DATA) | | HEEL LEANING ANGLE | | |
|---|---|---|---|---|
| | | EVERSION | AVERAGE | INVERSION |
| ARCH HEIGHT RATIO | HIGH ARCH | DATA A1 | DATA A2 | DATA A3 |
| | AVERAGE | DATA A4 | DATA A5 | DATA A6 |
| | FLAT | DATA A7 | DATA A8 | DATA A9 |

FIG.18

| UNLOADED FOOT SHAPE DATA (SECOND SAMPLE DATA) | | HEEL LEANING ANGLE | | |
|---|---|---|---|---|
| | | EVERSION | AVERAGE | INVERSION |
| ARCH HEIGHT RATIO | HIGH ARCH | DATA B1 | DATA B2 | DATA B3 |
| | AVERAGE | DATA B4 | DATA B5 | DATA B6 |
| | FLAT | DATA B7 | DATA B8 | DATA B9 |

SOCK LINER DESIGNING APPARATUS, SOCK LINER DESIGNING METHOD AND RECORDING MEDIUM FOR RECORDING PROGRAM

CROSS REFERENCE TO RELATED APPLICATIONS

This nonprovisional application is based on Japanese Patent Application No. 2022-134793 filed on 26 Aug. 2022 with the Japan Patent Office, the entire contents of which are hereby incorporated by reference.

BACKGROUND

Technical Field

The present disclosure relates generally to sock liner designs for articles of footwear and more particularly to sock liner designing apparatus, sock liner designing methods and a recording medium for a recording program.

Background Information

Conventionally, footwear sock liners (simply, sock liners) may be often produced to order. They are adapted to individual foot shapes and used to enhance the fitness and stability of footwear. For a sock liner designing apparatus used to design footwear sock liners. The apparatus calculates, based on a foot shape (foot data) and footwear data, a three-dimensional void formed between the inner surface of a space formed inside a footwear and the foot inserted in the space and then designs a sock liner based on the void's three-dimensional shape calculated earlier. (WO2017/057388, for example)

SUMMARY

The sock liner designing apparatus described in WO2017/057388, however, may design and produce a sock liner with an intention to keep the foot in a desired state when the sock liner and the footwear are combined and used. Thus, this apparatus may mostly focus on an improved fit of the foot in the footwear. However, functions of footwear desired by users may include but are not necessarily limited to such a fit.

To address these issues of the known art, the present disclosure is directed to providing a sock liner designing apparatus and a sock liner designing method for designing sock liners that can attain functions of footwear desired by users when they wear footwear combined with the sock liners.

A sock liner designing apparatus according to an aspect of the present disclosure is for use in designing a sock liner for footwear. The sock liner designing apparatus includes: an input circuitry that receives an input of foot data measured; a computer that calculates design data of the sock liner based on the foot data received through the input circuitry; and an output circuitry that outputs the design data calculated by the computer. The input circuitry further receives an input of a first function parameter and an input of a second function parameter, the first function parameter indicating functions of the footwear desired by a user, and the second function parameter indicating functions of the footwear selected by the user. The computer adjusts the design data based on a difference between the first function parameter and the second function parameter received through the input circuitry.

A sock liner designing method according to an aspect of the present disclosure is for use in designing a sock liner for footwear. The sock liner designing method includes: receiving an input of foot data measured; receiving an input of a first function parameter that indicates functions of the footwear desired by a user; receiving an input of a second function parameter that indicates functions of the footwear selected by the user; calculating design data of the sock liner based on the foot data received earlier; adjusting the design data based on a difference between the first function parameter and the second function parameter; and outputting the design data thus adjusted.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

FIG. 10 is a schematic diagram for describing Example 1, illustrating adjustments of design data using the sock liner designing apparatus according to the embodiment.

FIG. 13 is a schematic diagram for describing Example 2, illustrating adjustments of design data using the sock liner designing apparatus according to the embodiment.

FIG. 15 is a schematic diagram for describing Example 4, illustrating adjustments of design data using the sock liner designing apparatus according to the embodiment.

FIG. 17 is a table showing an example of loaded foot shape data.

FIG. 18 is a table showing an example of unloaded foot shape data.

DETAIL DESCRIPTION

Embodiments are hereinafter described with reference to the accompanying drawings. In the description below, the same configurations are illustrated with the same reference signs. Also, they are referred to likewise and have similar functional features. Such configurations, therefore, will not be repeatedly described in detail. In the description of embodiments given below, the "medial side" or "medial foot side" refers to a side of foot closer to the "first toe" in the direction of foot width, while the "lateral side" or "lateral foot side" refers to a side of foot closer to the "fifth toe" in the direction of foot width.

[Configuration of Sock Liner Designing Apparatus]

Figure 1:
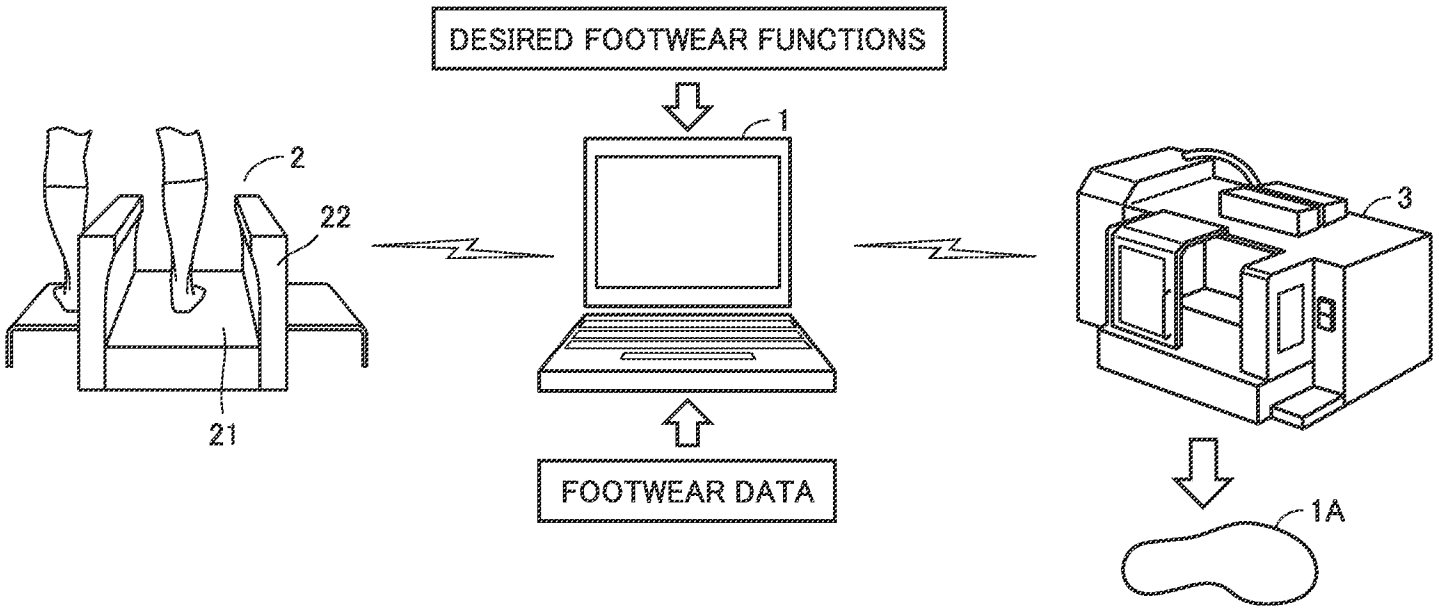
FIG. 1 is a schematic diagram illustrating a system configuration including a sock liner designing apparatus according to an embodiment.
Figure 2:
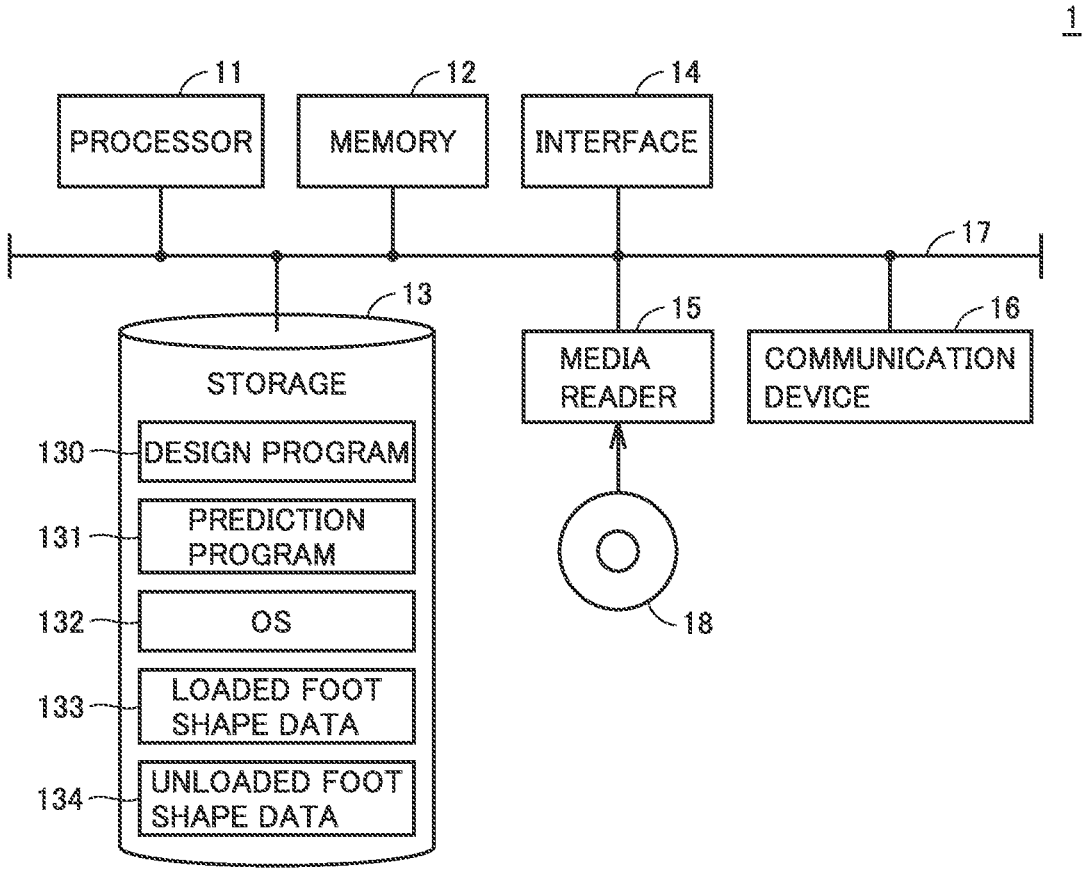
FIG. 2 is a block diagram illustrating a configuration of the sock liner designing apparatus according to the embodiment.
Figure 3:
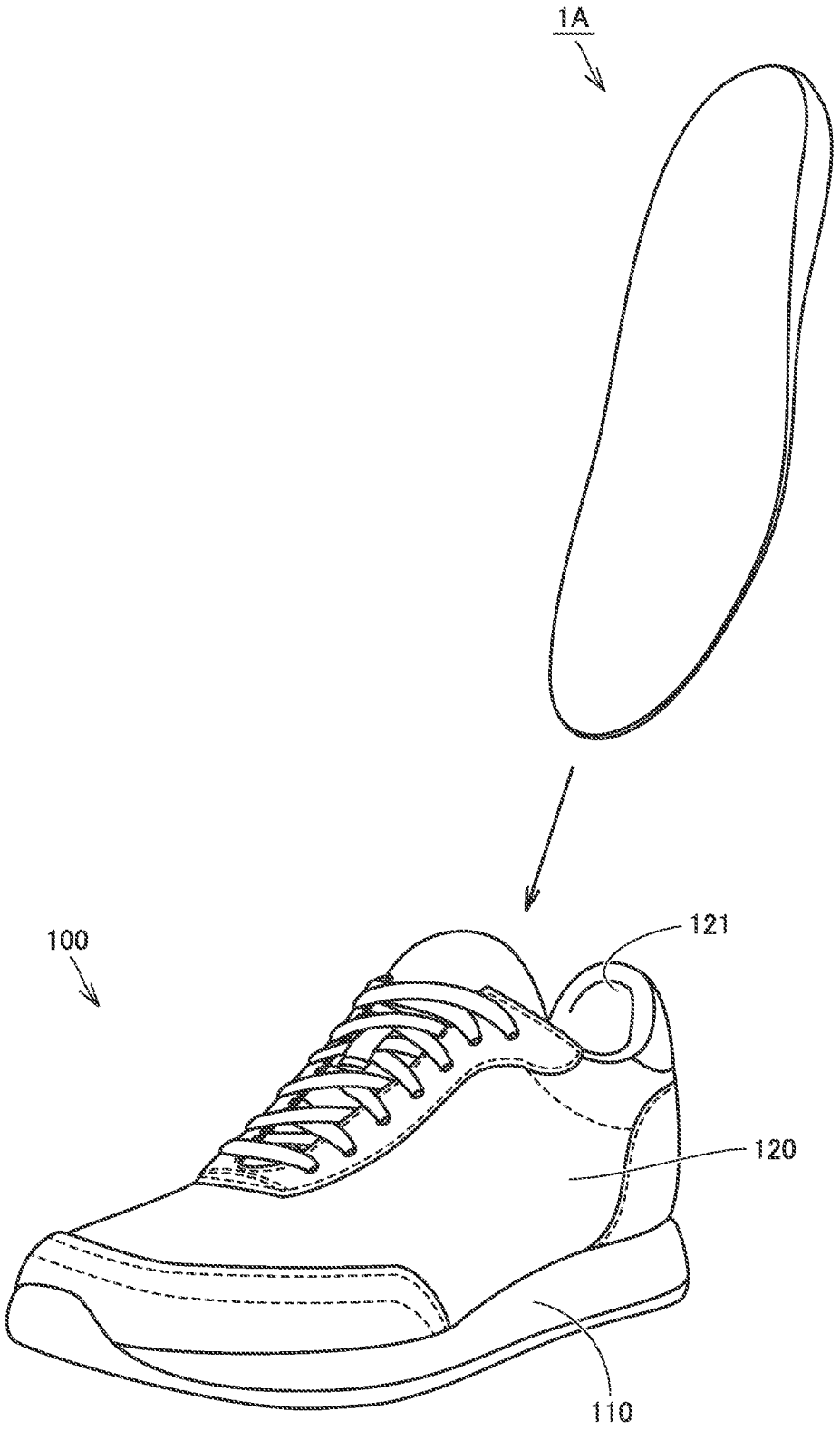
FIG. 3 is a schematic diagram for describing an example of use of a sock liner according to the embodiment.

FIG. 1 is a schematic diagram illustrating a system configuration including a sock liner designing apparatus 1 according to an embodiment. FIG. 2 is a block diagram illustrating a configuration of sock liner designing apparatus 1 according to the embodiment. FIG. 3 is a schematic diagram for describing an example of use of a sock liner 1A according to the embodiment. In shops like footwear stores or event venues, custom-made sock liners adapted to individual foot shapes, like a sock liner 1A, may be produced to order. Sock liner 1A is for use in a footwear 100; an example of footwear, as illustrated in FIG. 3. Footwear 100 has a sole 110 and an upper 120 attached to the sole. Before footwear 100 is worn, sock liner 1A is inserted in this footwear through a foot insertion opening 121 formed in upper 120. Sock liner 1A is inserted in footwear 100, with its lower surface facing the footwear's inner bottom surface, and is thus fitted onto footwear 100. Sock liner 1A, which is used as the footbed of footwear 100 in the description below, only needs to be usable in any other footwear, for example, may be used as sandals.

While a user is wearing footwear 100, the sole of user's foot rests on the upper surface of sock liner 1A. Sock liner 1A is pressed by the user's sole and sole 110 of footwear 100 and is thereby allowed to support the user's foot. While the user's foot is staying in the internal space of footwear 100, sock liner 1A fills a void formed between the foot and the internal space of footwear 100, improving the fit of footwear 100.

Improved fit of footwear 1A may not be the only purpose of sock liner 1A. Sock liner 1A may be allowed to change functions of footwear 100 (for example, cushioning, stability, grip) through adjustments of design data of sock liner 1A (for example, material, structure, cup height and thickness at each portion). Sock liner designing apparatus 1 is aimed at generating design data of sock liner 1A adjustable to attain functions of footwear 100 desired by a user.

As illustrated in FIG. 1, a sock liner production system including sock liner designing apparatus 1 includes sock liner designing apparatus 1, a measuring apparatus 2, and a 3D printer 3. The apparatus used to produce sock liner 1A is not necessarily limited to 3D printer 3 and may be selected from other apparatuses, an example of which is an NC working machine. This embodiment presents an example in which design data for production of sock liner 1A is generated by sock liner designing apparatus 1. The technique of the present disclosure may be applied to a designing apparatus used to produce custom-made footwear to allow the designing apparatus to generate design data for production of sock liner 1A.

Measuring apparatus 2 may be, for example, a 3D foot type scanner using laser. This apparatus includes a top board 21 and laser measuring units 22 disposed on sides across the top board. When a subject (user) in the upright position rests subject's foot on top board 21, a load is applied from the foot onto top board 21 under the subject's weight. This may be rephrased that the load is being imposed on the subject's foot. Measuring apparatus 2, with the load being thus imposed on the subject's foot, measures subject's foot shape using laser measuring unit 22 while moving from the toe to heel. Measuring apparatus 2 outputs, to sock liner designing apparatus 1, the subject's data including subject's foot shape data (foot data) obtained by laser measuring units 22. The subject's data only needs to include at least the foot shape data obtained by measuring apparatus 2 and may further include other pieces of data (for example, personal data such as the subject's gender and/or age).

Sock liner designing apparatus 1 obtains the subject's data from measuring apparatus 2 and generates design data for production of sock liner 1A based on the obtained data of subject. Sock liner designing apparatus 1 generates the design data of sock liner 1A that can attain functions of footwear 100 desired by a user when the user wears footwear 100 using sock liner 1A. Specifics of this data generation will be described in detail later. Sock liner designing apparatus 1 outputs the generated design data of sock liner 1A to 3D printer 3 for production of sock liner 1A.

In the sock liner production system described herein, sock liner designing apparatus 1 is used to generate the design data of sock liner 1A based on the foot shape of subject (foot data) obtained by measuring apparatus 2, and 3D printer 3 is used to produce sock liner 1A. Based on the design data of sock liner 1A generated by sock liner designing apparatus 1, the sock liner production system may be thus allowed to readily provide sock liner 1A that can attain functions of footwear 100 desired by a user when the user wears footwear 100 using sock liner 1A. In the present disclosure, sock liner 1A is produced by the sock liner production system including sock liner designing apparatus 1, measuring apparatus 2 and 3D printer 3. These apparatuses, however, may be configured otherwise. For instance, sock liner designing apparatus 1, measuring apparatus 2 and 3D printer 3 may be combined into an integral unit of the system, or measuring apparatus 2 and 3D printer 3 alone may be combined into an integral unit of the system. In the present disclosure, instead of the whole sock liner 1A being produced by 3D printer 3, sock liner 1A in part may be produced by 3D printer 3. In case, for example, a sock liner has been made and available, some additional parts for this sock liner may be produced by 3D printer 3 and then combined with the sock liner into a new custom-made sock liner. The sock liner production system that produces custom-made sock liners may be allowed to select a plurality of sock liner parts already available based on information including individual foot shapes and then combine these parts into a sock liner.

[Configuration of Prediction Apparatus]

As illustrated in FIG. 2, sock liner designing apparatus 1 includes a processor 11, a memory 12, a storage 13, an interface 14, a medium reader 15, and a communication device 16. These devices and units are interconnected through a processor bus 17.

Processor 11 is an example of the "computer". Processor 11 is a computer that reads out a program stored in storage 13 (for example, design program 130, prediction program 131 and OS (Operating System) 132) and then loads and runs the read program in memory 12. Processor 11 may include, for example, CPU (Central Processing Unit), FPGA (Field Programmable Gate Array), GPU (Graphics Processing Unit) or MPU (Multi Processing Unit). Processor 11 may include a processing circuitry.

Memory 12 includes a volatile memory, for example, DRAM (Dynamic Random Access Memory) or SRAM (Static Random Access Memory), or may include a non-volatile memory, for example, ROM (Read Only Memory) or flash memory.

Storage 13 is an example of the "storage". Storage 13 may include a non-volatile storage device, for example, HDD (Hard Disk Drive) or SSD (Solid State Drive). In storage 13 are stored a design program 130, a prediction program 131, an OS 132, a loaded state foot shape data 133, and an unloaded foot shape data 134.

Design program 130 is a program run to execute a process to design sock liner 1A that can attain functions of footwear 100 desired by a user when the user wears footwear 100 using this sock liner (designing process of FIG. 9 described later).

Prediction program 131 is a program run to predict foot shape of a user in an unloaded state. Prediction program 131 is a program run to execute a process, using sock liner designing apparatus 1, to predict a user's foot shape in the unloaded state (prediction process of FIG. 16 described later) based on the user's foot shape in a loaded state obtained by measuring apparatus 2.

Loaded foot shape data 133 is data used to predict a user's foot shape in the unloaded state. Loaded foot shape data 133 is an example of the "first sample data", which contains data calculated from pieces of foot shape data of a plurality of samples in the loaded state. Loaded foot shape data 133 will be described later in detail using FIG. 17.

Unloaded foot shape data 134 is used to predict a user's foot shape in the unloaded state. Unloaded foot shape data 134 is an example of the "second sample data", which contains data calculated from pieces of foot shape data of a plurality of samples in the unloaded state. Unloaded foot shape data 134 will be described later in detail using FIG. 18.

Interface 14 is an example of the "input circuitry" or "output circuitry". Interface 14 receives inputs from a user who is using sock liner designing apparatus 1, and includes a keyboard, mouse, and touch device.

Medium reader 15 is configured to receive a recording medium, for example, a removable disc 18 and then obtain data stored in this removable disc 18.

Communication device 16 is an example of the "input circuitry" or "output circuitry". Communication device 16 transmits and receives data to and from other devices through wireless or wired communication. For example, communication device 16 communicates with measuring apparatus 2 to obtain foot shape data obtained by measuring apparatus 2. Through communicates with 3D printer 3, communication device 16 outputs, to 3D printer 3, the design data of sock liner 1A used for production of this sock liner.

Sock liner designing apparatus 1 does not necessarily receive the foot shape data from measuring apparatus 2 through communication device 16. For instance, sock liner designing apparatus 1 may receive the foot shape data inputted by a user using interface 14. Instead, sock liner designing apparatus 1 may read the foot shape data stored in removable disc 18 using medium reader 15.

[Design Data of Sock Liner 1A]

With reference to FIGS. 4 to 8, design data of sock liner 1A is hereinafter described. The design data of sock liner 1A includes shape-related parameters, for example, length and width and further includes adjustment parameters, for example, material, structure, cup height in each portion, sock liner compressibility, thickness in each portion, arch position and bottom surface shape. It should be noted that the functions of footwear 100 may be changeable insofar as the design data of sock liner 1A includes, in addition to the shape-related parameters, at least one of the before-mentioned adjustment parameters, for example, material, structure, cup height in each portion, sock liner compressibility, thickness in each portion, arch position and bottom shape.

Of the adjustment parameters includable in the design data of sock liner 1A, the material refers to a material(s) used to make sock liner 1A. Through cushioning adjustment of the material used, some or all of the required functions including: cushioning, grip, flexibility, durability, resilience, and light weight, may be conferred on a sock liner to be produced. In case the material of sock liner 1A is or includes a resin(s), for example, the resin may be selected from polyolefin resins, ethylene-vinyl acetate copolymers (EVA), polyamide-based plastic elastomers (TPA, TPAE), thermoplastic polyurethanes (TPU), and polyester-based thermoplastic elastomers (TPEE). In case a rubber is the material of sock liner 1A, butadiene rubber (BR), for example, may be selected and used. In case any polymer addable to polymer compositions is used as the material of sock liner 1A, for example, an olefin-based polymer may be selected from olefin-based elastomers and olefin-based resins. The olefin-based polymer may be selected from polyolefins, specific examples of which may include polyethylenes (e.g., linear low-density polyethylene (LLDPE)), high-density polyethylenes (HDPE), polypropylenes, ethylene-propylene copolymers, propylene-1-hexane copolymers, propylene-4-methyl-1-pentene copolymers, propylene-1-butene copolymers, ethylene-1-hexane copolymers, ethylene-4-methyl-pentene copolymers, ethylene-1-butene copolymers, 1-butane-1-hexane copolymers, 1-butene-4-methyl-pentene, ethylene-methacrylate copolymers, ethylene-methacrylate methyl copolymers, ethylene-methacrylate ethyl copolymers, ethylene-methacrylate butyl copolymers, ethylene-methyl acrylate copolymers, ethylene-ethyl acrylate copolymers, ethylene-butyl acrylate copolymers, propylene-methacrylate copolymers, propylene-methacrylate methyl copolymers, propylene-methacrylate ethyl copolymers, propylene-methacrylate butyl copolymers, propylene methyl acrylate copolymers, propylene ethyl acrylate copolymers, propylene-butyl acrylate copolymers, ethylene-vinyl acetate copolymers, and propylene-vinyl acetate copolymers.

The polymer mentioned above may be an amide-based polymer selected from amide-based elastomers and amide-based resins. Specific examples of the amide-based polymer may include polyamide 6, polyamide 11, polyamide 12, polyamide 66, and polyamide 610.

The polymer may be selected from ester-based polymers, for example, ester-based elastomers and ester-based resins. Specific examples of the ester-based polymers may include polyethylene terephthalate and polybutylene terephthalate.

The polymer may be selected from urethane-based polymers, for example, urethane-based elastomers and urethane-based resins. Specific examples of the urethane-based polymers may include polyester-based polyurethanes and polyether-based polyurethanes.

The polymer may be selected from styrene-based polymers, for example, styrene-based elastomers and styrene-based resins. Specific examples of the styrene-based elastomer may include styrene-butylene copolymers (SEB), styrene-butadiene-styrene copolymers (SBS), hydrogenated SBS (styrene-ethylene-butylene-styrene copolymers (SEBS), styrene-isoprene-styrene copolymers (SIS), hydrogenated SIS (styrene-ethylene-propylene-styrene copolymers (SEPS), styrene-isobutylene-styrene copolymers (SIBS), styrene-butadiene-styrene butadiene (SBSB), and styrene-butadiene-styrene butadiene-styrene (SBSBS). Specific examples of the styrene-based resins may include acrylonitrile styrene resins (AS) and acrylonitrile butadiene styrene resins (ABS).

Specific examples of the polymer may include: acrylic polymers such as polymethacrylate methyl, urethane-based acrylic polymers, polyester-based acrylic polymers, polyether-based acrylic polymers, polycarbonate-based acrylic polymers, epoxy-based acrylic polymers, conjugated diene polymer-based acrylic polymers and hydrogenated materials thereof; urethane-based methacrylic polymers, polyester-based methacrylic polymers, polyether-based methacrylic polymers, polycarbonate-based methacrylic polymers, polyester-based urethane acrylates, polycarbonate-based urethane acrylates, polyether-based urethane acrylates, epoxy-based methacrylic polymers, conjugated diene polymer-based methacrylic polymers and hydrogenated materials thereof; polyvinyl chloride-based resins; silicone-based elastomers; butadiene rubbers, isoprene rubbers (IR); chloroprene rubbers (CR); natural rubbers (NR); styrene butadiene rubbers (SBR); acrylonitrile butadiene rubbers (NBR); and butyl rubbers (IIR).

The material of sock liner 1A may be selected from biodegradable materials or composite materials (for example, material in which carbon fiber, glass fiber, rubber and/or resin are combined). As for the material used to product sock liner 1A, the whole sock liner 1A may be made of one material, sock liner 1A may be made of one material, with the degree of hardness being changed in the sock liner's different portions, or different portions of sock liner 1A may be made of materials that differ in functions.

Figure 4:
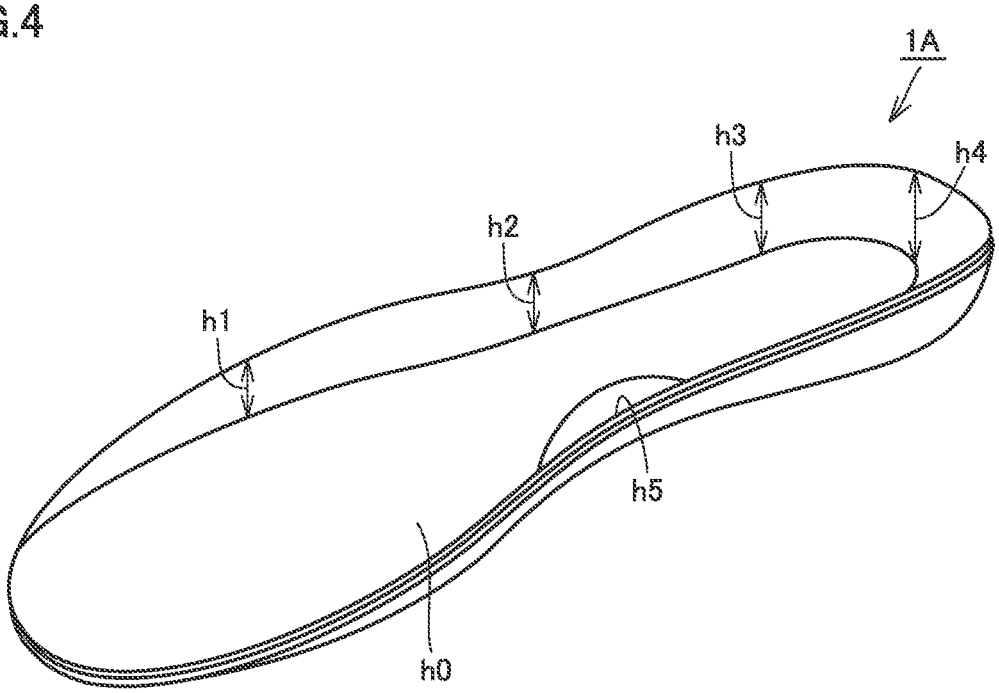
FIG. 4 is a schematic diagram for describing cup heights measured at different portions of the sock liner according to the embodiment.

Of the adjustment parameters includable in the design data of sock liner 1A, the cup height in each portion refers to a side wall height in each portion of sock liner 1A measured from the inner bottom surface of this sock liner. Adjustment of the cup height in each portion may confer required functions of sock liner 1A including: fit, stability, support against cutting moves, and arch support on this sock liner. FIG. 4 is a schematic diagram for describing cup heights measured at different portions of sock liner 1A according to the embodiment. As illustrated in FIG. 4, sock liner 1A has the following heights at different positions: side wall height h1 measured from an inner bottom surface h0 of sock liner 1A at a lateral toe-side position, side wall height h2 measured from inner bottom surface h0 of sock liner 1A at a lateral middle position, and side wall height h3 measured from inner bottom surface h0 of sock liner 1A at a lateral heel-side position. Sock liner 1A further has the following heights: side wall height h4 measured from inner bottom surface h0 of sock liner 1A at a rear heel position, and side wall height h5 measured from inner bottom surface h0 of sock liner 1A at a medial arch position.

Figure 5:
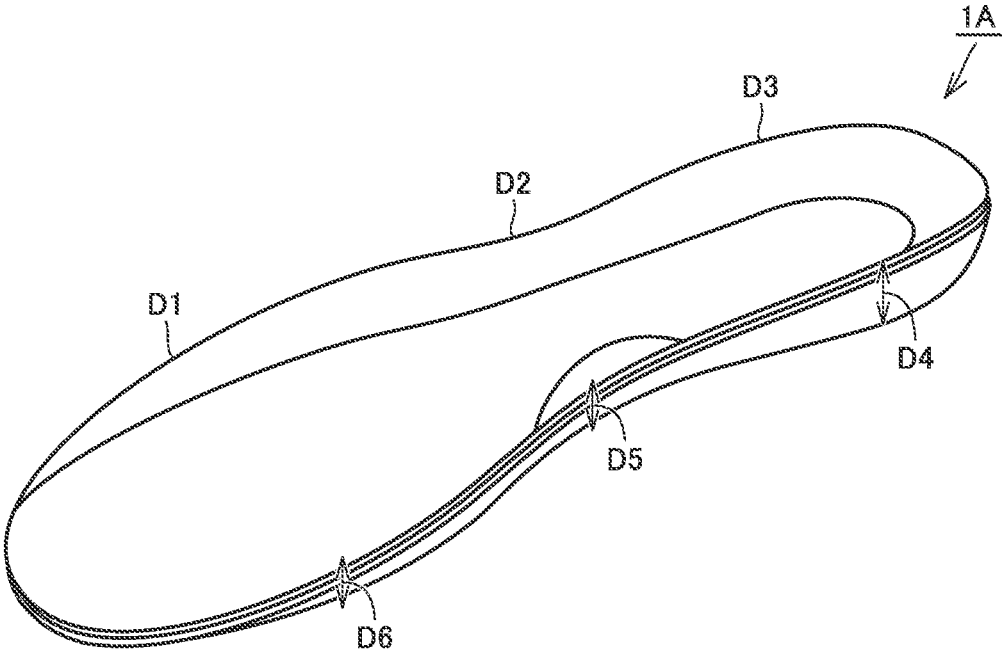
FIG. 5 is a schematic diagram for describing thicknesses of different portions of the sock liner according to the embodiment.

Of the adjustment parameters includable in the design data of sock liner 1A, the thickness in each portion refers to the thickness of sock liner 1A measured in each portion of this sock liner. Through adjustment of the thickness in each portion, some or all of the required functions including: cushioning, flexibility, fit, light weight, resilience, and support against cutting moves, are conferred on a sock liner to be produced. FIG. 5 is a schematic diagram for describing thicknesses in different portions of sock liner 1A according to the embodiment. As illustrated in FIG. 5, sock liner 1A has thickness D1 at a lateral toe-side position of sock liner 1A, thickness D2 at a lateral middle position of sock liner 1A, and thickness D3 at a lateral heel-side position of sock liner 1A. Sock liner 1A further has thickness D4 at a medial heel-side position of sock liner 1A, thickness D5 at a medial middle position of sock liner 1A, and thickness D6 at a medial toe-side position of sock liner 1A.

Figure 6:
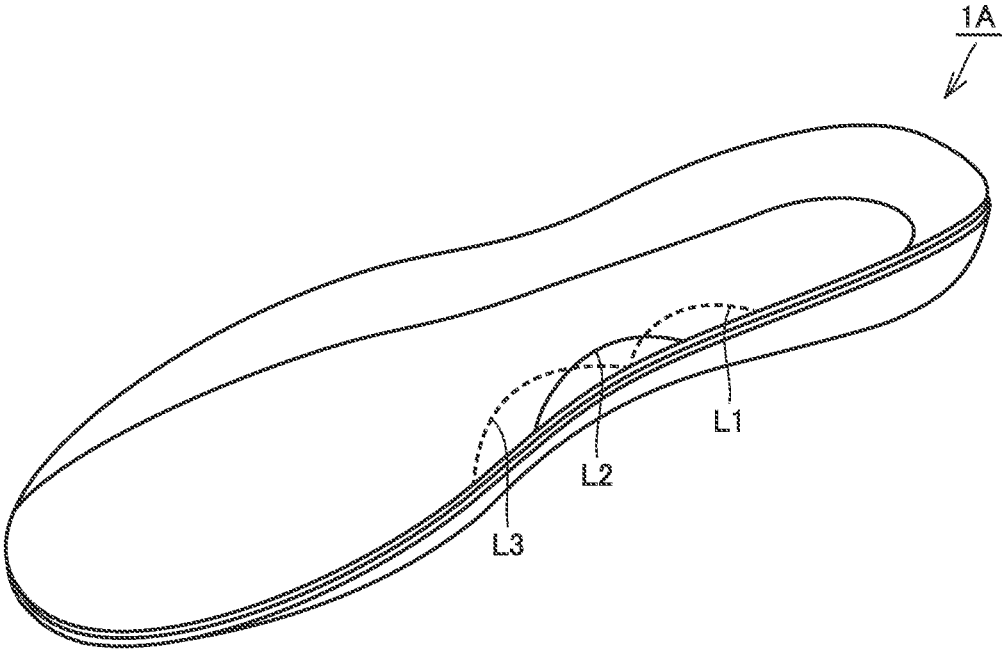
FIG. 6 is a schematic diagram for describing an arch position in the sock liner according to the embodiment.

Of the adjustment parameters includable in the design data of sock liner 1A, the arch position refers to the arch position in sock liner 1A at which the arch of foot is supportable. FIG. 6 is a schematic diagram for describing the arch position in sock liner 1A according to the embodiment. As illustrated in FIG. 6, sock liner 1A has the following arch positions: L1 at which the arch is at a heel-side position, L2 at which the arch is at a middle position, and L3 at which the arch is at a toe-side position. Three arch positions L1 to L3 are simply illustrated in FIG. 6, so that the arch position can be clearly and easily described. Normally, an arch top position is decided based on a foot shape obtained by predictive transform of a user's foot shape, and the arch position is then calculated and identified.

Figure 7:
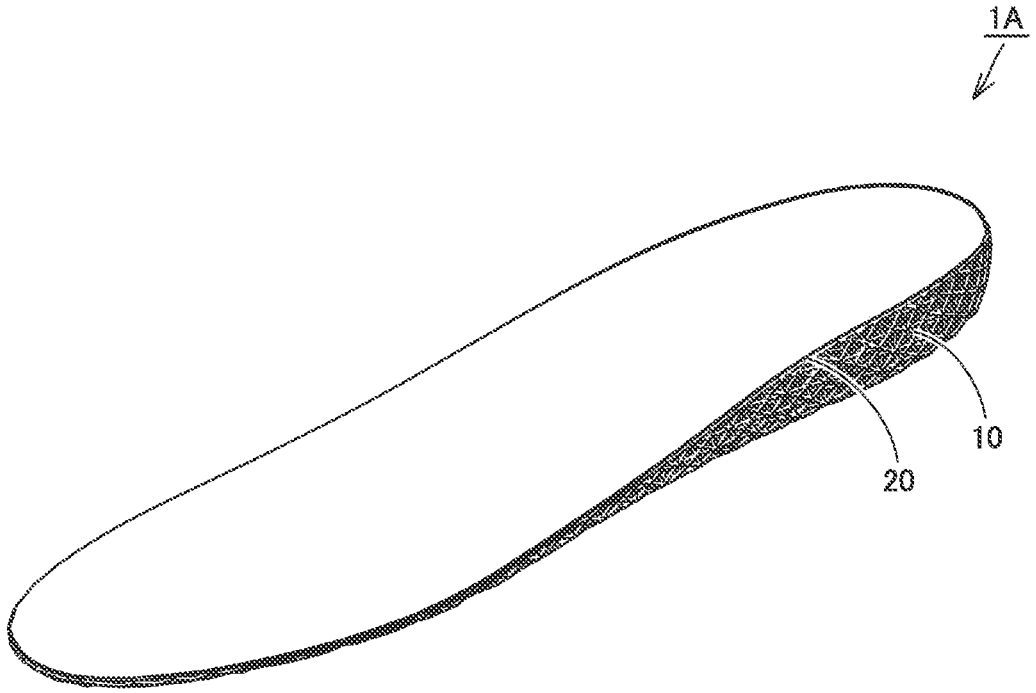
FIG. 7 is a schematic diagram illustrating a sock liner in the form of a three-dimensional mesh structure.

Of the adjustment parameters included in the design data of sock liner 1A, the structure indicates whether sock liner 1A has a flat shape or a planar structure in the form of gyroid or lattice (three-dimensional mesh structure). The structural adjustments may confer some or all of the required functions including: cushioning, stability, grip, flexibility, durability, ventilation, light weight, resilience, and support against cutting moves, on a sock liner to be produced. FIG. 7 is a schematic diagram of sock liner 1A produced in the form of a three-dimensional mesh structure. With reference to FIG. 7, sock liner 1A in the form of a three-dimensional mesh structure has a two layer structure including a base portion 10 and an upper portion 20. The three-dimensional mesh structure of sock liner 1A may be formed using a three-dimensional additive manufacturing method, for example, stereolithography.

Figure 8:
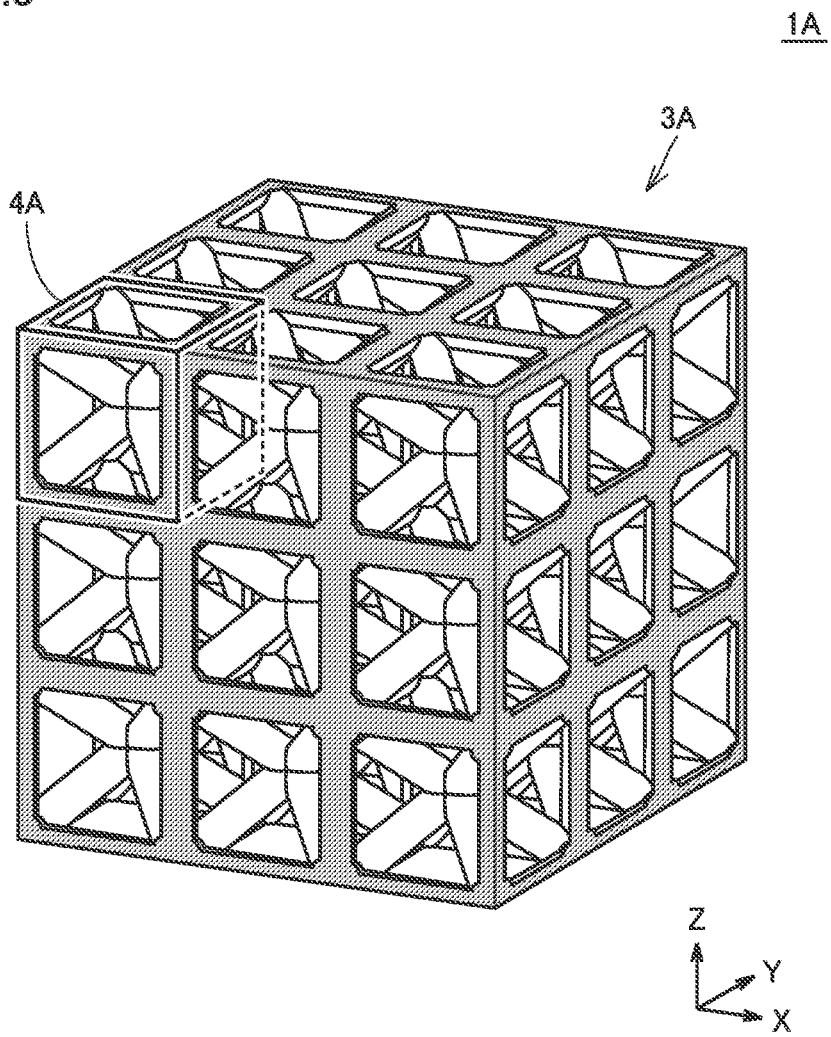
FIG. 8 is a schematic diagram for describing the three-dimensional structure in a base portion of the sock liner of FIG. 7.

Base portion 10 has a three-dimensional mesh structure in which a plurality of unit structures; each being a lattice structure, are arranged repeatedly. FIG. 8 is a schematic diagram for describing the three-dimensional structure in a base portion of the sock liner of FIG. 7. As illustrated in FIG. 8, base portion 10 of sock liner 1A has a three-dimensional mesh structure 3A in which a plurality of unit structures 4A; each being a lattice structure, are arranged repeatedly. To be more specific, a plurality of unit structures 4A are arranged repeatedly and continuously in a regular pattern along a direction of width (X direction in the drawing), a direction of depth (Y direction in the drawing) and a direction of height (Z direction in the drawing). FIG. 8 presents three units structure 4A adjacent to one another along the directions of width, depth and height and its fracture cross-sectional surfaces illustrated in a dark color.

Lattice-like unit structure 4A has a three-dimensional shape in which a plurality of pillars extending in predetermined directions are connected to one another. Unit structure 4A may be employed from various examples including cuboidal lattice, diamond lattice, octahedron lattice, double-pyramid lattice, and these lattice structures provided with variously different supports. Unit structure 4A illustrated in the drawing is a center support-added cuboidal lattice.

Sock liner 1A with such base portion 10 on its lower side may be flexibly deformable. Sock liner 1A may thus excel in shock absorbency, comfortableness, and stability for a user who is wearing this sock liner. Base portion 10 thus structured may lead to weight reduction of the sock liner in proportion to its size and may allow the sock liner to improve in ventilation.

One of the adjustment parameters included in the design data of sock liner 1A is the sock liner compressibility. Through adjustments of the sock liner compressibility, the required functions including: stability, fit, and arch support, may be attained. The sock liner compressibility refers to the compressibility of a space formed by the foot shape and the inner bottom surface of sock liner 1A, and 100% indicates the whole space being completely occupied. The adjustment parameters included in the design data of sock liner 1A disclosed herein are just exemplified ones and may include other parameters.

The design data of sock liner 1A includes, other than the adjustment parameters, a sock liner's bottom surface shape as a fundamental parameter. The bottom surface shape may represent, for example, irregularities on the outer bottom surface of sock liner 1A. When footwear 100 to be mounted with sock liner 1A is selected, the bottom shape of sock liner 1A is defined correspondingly to the inner bottom surface of footwear 100. The bottom surface shape, therefore, may be considered to be a fundamental parameter used to design sock liner 1A. Sock liner 1A may have a curved surface(s) at an end portion(s) in terms of production efficiency and user-friendliness.

[Generation of Design Data of Sock Liner 1A]

Figure 9:
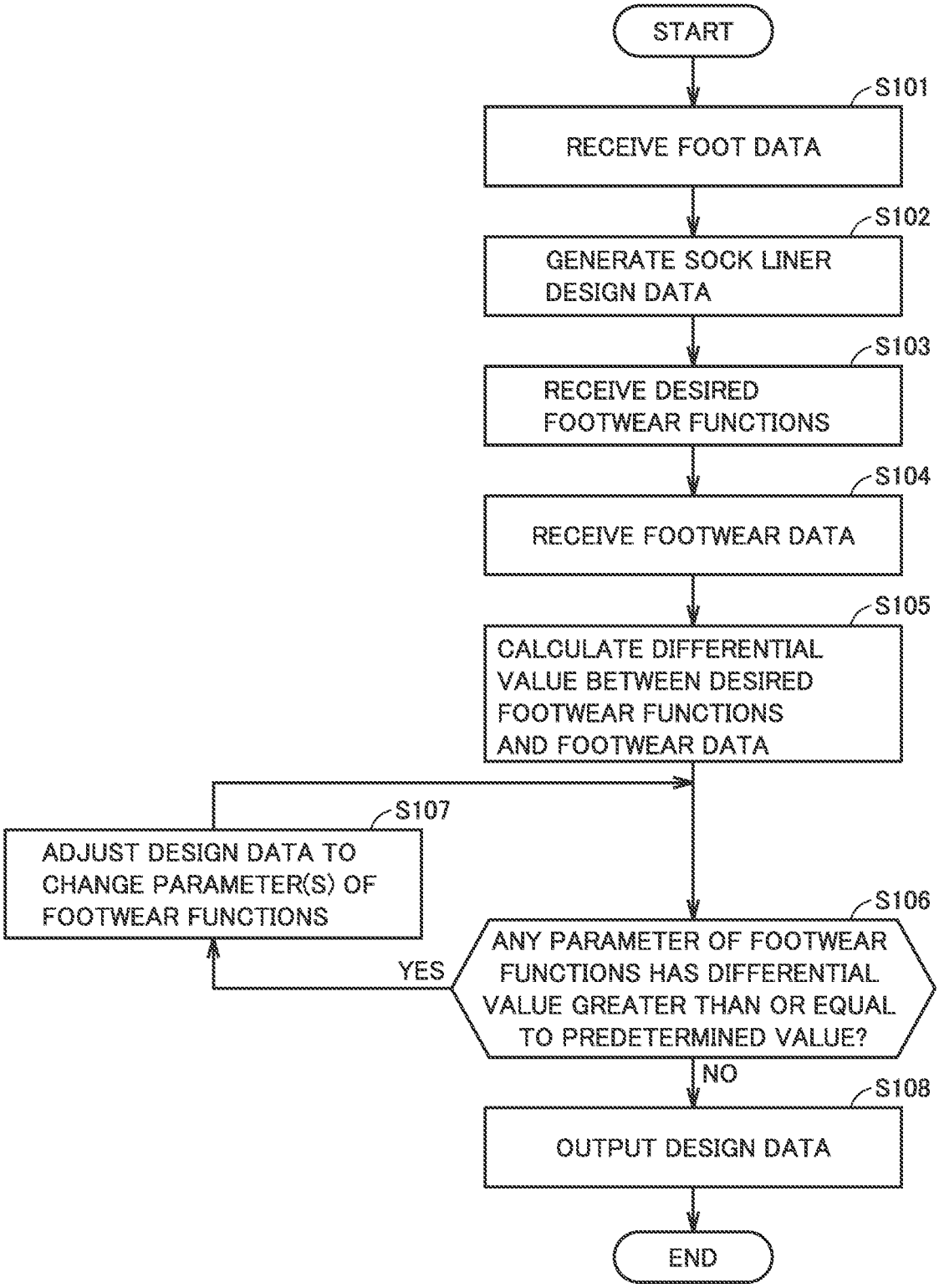
FIG. 9 is a flow chart of a designing process carried out by the sock liner designing apparatus according to the embodiment.

With reference to FIGS. 9 to 15, a designing process to generate the design data of sock liner 1A using sock liner designing apparatus 1 is hereinafter described. FIG. 9 is a flow chart of the designing process carried out by sock liner designing apparatus 1 according to the embodiment. Steps illustrated in FIG. 9 (step numbers starting with "S") are carried out by having design program 130 run by processor 11 of sock liner designing apparatus 1.

As illustrated in FIG. 9, sock liner designing apparatus 1 receives foot data obtained by measuring apparatus 2 (S101). Sock liner designing apparatus 1 generates the design data of sock liner 1A based on the foot data received in S101 (S102). In the design data of sock liner 1A generated in this step, shape-related parameters of the foot data alone have been optimized. This design data of sock liner 1A is obtained by allowing this sock liner to fit well to the foot shape using a conventional means.

Sock liner designing apparatus 1 receives functions of footwear desired by a user (first function parameter) (S103). The functions of footwear only need to include at least one of the following function parameters: cushioning, stability, grip, flexibility, fit, durability, ventilation, light weight, resilience, support against cutting moves and arch support. These function parameters included in the footwear functions disclosed herein are just exemplified ones and may include other parameters.

The function parameters includable in the footwear functions are hereinafter described in detail. The function parameters includable in the footwear functions may already be preset by the time when footwear designing and development are finished. Of the function parameters includable in the footwear functions, the cushioning indicates the shock absorbency of footwear 100 when footwear 100 hits the ground. The cushioning may be evaluated based on a performance evaluation result in terms of design and may also be evaluated in five grades of any impact based on the sensation of a user when user's foot wearing footwear 100 hits the ground. The cushioning may be evaluated using a sensor attached to a user's body or footwear 100 or may be evaluated by measuring, using a measuring device, a force acting upon the sensor when a user's foot wearing footwear 100 hits the ground.

Of the function parameters includable in the footwear functions, the stability indicates the performance of footwear 100, for example, any shift of the ground surface hit by footwear 100 relative to the horizontal direction or any sideways lean on the frontal plane toward lateral sides relative to the ground surface. The stability may be evaluated based on a performance evaluation result in terms of design and may also be evaluated in five grades of any lean in the frontal plane or in five grades of any directional shift relative to the horizontal direction based on the sensation of a user wearing footwear 100 hits the ground. The stability may be evaluated by measuring, using image analysis or a sensor attached to a user's body or footwear 100, any directional shift relative to the horizontal direction based on the sensation of a user wearing footwear 100 hits the ground or may be evaluated by measuring any sideways lean on the frontal plane based on displacement, angles and/or ground reaction changes.

Of the function parameters includable in the footwear functions, the grip indicates the amount of friction between footwear 100 worn by a user in motion and the ground surface on which footwear 100 landed or the amount of friction between the inside of footwear 100 and a user's foot. The grip may be evaluated based on a performance evaluation result in terms of design and may also be evaluated in five grades of any friction between footwear 100 worn by a user in motion and the ground surface on which footwear 100 landed. The grip may be evaluated by measuring, using a measuring device, any friction between footwear 100 worn by a user in motion and the ground surface on which footwear 100 landed.

Of the function parameters includable in the footwear functions, the flexibility indicates how easily footwear 100 worn by a user is bendable when the user is in motion. The flexibility may be evaluated based on a performance evaluation result in terms of design and may also be evaluated in five grades of how easily footwear 100 worn by a user is bendable based on the sensation of a user in motion wearing footwear 100. The flexibility may be evaluated by measuring, using a measuring device, the flexibility of footwear 100 when a load is imposed on footwear 100.

Of the function parameters includable in the footwear functions, the ventilation indicates the amount of air passing through footwear 100. The ventilation may be evaluated based on a performance evaluation result in terms of design and may also be evaluated in five grades of how easily air is allowed to pass through footwear 100 based on the sensation of a user wearing footwear 100. The ventilation may be evaluated by measuring, using a measuring device, the temperature and humidity of footwear 100 and the amount of air passing through footwear 100.

Of the function parameters includable in the footwear functions, the light weight indicates the weight of footwear 100. The light weight may be evaluated based on a performance evaluation result in terms of design and may also be evaluated in five grades of the weight of footwear 100 based on the sensation of a user wearing footwear 100. The light weight may be evaluated by measuring, using a measuring device, the weight of footwear 100.

Of the function parameters includable in the footwear functions, the resilience indicates the dimension of a force that pushes back footwear 100 that hits the ground. The resilience may be evaluated based on a performance evaluation result in terms of design and may also be evaluated in five grades of the dimension of a force that pushes back footwear 100 that hits the ground based on the sensation of a user wearing footwear 100. Optionally, a weight may be dropped from a certain height onto the sole of footwear 100 to measure a bounce-back height ratio (largest bounce-back height/initial height), which may also be used to evaluate the resilience.

Of the function parameters includable in the footwear functions, the support against cutting moves indicates the sense of stability when a user wearing footwear 100 makes a turn to right or left. The support against cutting moves may be evaluated based on a performance evaluation result in terms of design and may also be evaluated in five grades of the sense of stability felt by a user wearing footwear 100 makes a turn to right or left. The support against cutting moves may be evaluated by measuring, using image analysis, the ground reaction or the degree of lateral deformation of footwear 100 when a user wearing footwear 100 turns to right or left.

Of the function parameters includable in the footwear functions, the arch support indicates the sense of a user's foot arch being supported when the user is wearing footwear 100. The arch support may be evaluated based on a performance evaluation result in terms of design and may also be evaluated in five grades of the sense of a user's foot arch being supported when the user is wearing footwear 100. The arch support may be evaluated by measuring, using a measuring device, the size and/or hardness of an arch support portion.

The indicators used to evaluate the footwear functions and how to evaluate such indicators described thus far are just examples and are not necessarily limited to such. The function parameters of the footwear functions, which are given herein as examples, may be replaced with other function parameters that indicate typical footwear functions.

The footwear functions desired by a user (first function parameter) may be directly inputted to sock liner designing apparatus 1. Instead, information, such as purpose, game or sport in which footwear is used, and/or a user's gender, age, weight, pronation, average running/walking speed, average running/walking distance, ground surface, past injury(ies), may be inputted to present recommended footwear functions suitable for a user's habit of use, thus assisting the user when the user inputs the desired footwear functions. In sock liner designing apparatus 1, footwear functions obtained from a user's history of ordered footwear may be stored in advance in storage 13 to assist the input of desired improvements based on the functions of the previously ordered footwear. In sock liner designing apparatus 1, well-known athletes' footwear functions may be stored in advance in storage 13 to present them when a user inputs desired footwear functions, or any athletes' footwear functions that the user acquired through the Internet may be read into the apparatus to assist the user when the user inputs the desired footwear functions. In sock liner designing apparatus 1, footwear functions selected by individuals with different habits of use may be stored in advance in storage 13 to read footwear functions suitable for any individual's habit of use similar to a user's habit of use, thus assisting the user when the user inputs the desired footwear functions. Sock liner designing apparatus 1 may be configured to consult information such as footwear functions posted on a social networking service (SNS) site, an online shop, and the like selected by viewers and purchasers to assist a user when the user inputs the desired footwear functions.

Sock liner designing apparatus 1 receives footwear data of footwear 100 in which sock liner 1A will be used (second function parameter) (S104). The footwear data only needs to include, for example, at least one of the following function parameters: cushioning, stability, grip, flexibility, fit, durability, ventilation, light weight, resilience, support against cutting moves, and arch support, to be compared with the footwear functions received in S103. The function parameters includable in the footwear data disclosed herein are just exemplified ones and may include other parameters. In sock liner designing apparatus 1, the footwear data of footwear 100 has been supplied and received from the manufacturer of footwear 100 and is already stored in storage 13. A user may directly input, to sock liner designing apparatus 1, footwear data of any footwear 100 not stored yet in storage 13. For example, the user may visit a shop(s) and evaluate footwear 100 sold there and then input the footwear data to sock liner designing apparatus 1.

Sock liner designing apparatus 1 calculates a differential value(s) between the footwear functions desired by the user and received in S103 and the footwear data received in S104 (S105). Sock liner designing apparatus 1 determines whether the differential value calculated in S105 of any parameter(s) of the footwear functions is greater than or equal to a predetermined value (S106). When the earlier step determines that the differential value of any parameter(s) of footwear functions is greater than or equal to a predetermined value (YES in S106), sock liner designing apparatus 1 adjusts the design data of sock liner 1A to change the parameter(s) of footwear parameters as desired by user (S107).

Examples are hereinafter described, in which sock liner designing apparatus 1 adjusts the design data of sock liner 1A to change the footwear data of footwear 100 in accordance with the user's desired footwear functions. FIG. 10 is a schematic diagram for describing Example 1, illustrating adjustments of design data using the sock liner designing apparatus 1 according to the embodiment. In Example 1, sock liner 1A allowed to change footwear functions is produced by sock liner designing apparatus 1 when footwear 100 purchased by a user are running footwear, and the user wants to wear these footwear 100 in a game or sport that often demands cutting moves in direction, like tennis or basketball.

First, sock liner designing apparatus 1 receives the input of required footwear functions of a game or sport like tennis or basketball desired by a user (S103). As illustrated in FIG. 10, the required footwear functions are; "4" for stability and grip, and "5" for light weight and support against cutting moves. Five grades are defined for the evaluation of footwear functions, ranging from the lowest "1" to the highest "5". Depending on the purpose of use, any irrelevant parameters of the footwear functions are rated as "n/a" and excluded from the criteria of evaluation. In the example of FIG. 10, of the required footwear functions of a game or sport like tennis or basketball, the cushioning and durability are excluded from the criteria of evaluation.

The model number of footwear 100 purchased by the user is inputted to sock liner designing apparatus 1 to read, from storage 13, the footwear data of footwear 100 corresponding to the inputted model number. Then, the read footwear data is received by sock liner designing apparatus 1 (S104). As illustrated in FIG. 10, the received footwear data of footwear 100 is; "3" for stability and grip, "4" for light weight, and "2" for support against cutting moves. As for the footwear data of footwear 100, values of evaluation have been inputted to all of the parameters as illustrated in FIG. 10, which are not necessarily limited to the use of this example.

The differential values between the required footwear functions and the footwear data of footwear 100 are calculated by sock liner designing apparatus 1 (S105). As illustrated in FIG. 10, the calculated differential values are "1" for stability, grip and light weight, and "3" for support against cutting moves. Sock liner designing apparatus 1 determines that any parameter of the footwear functions with a differential value greater than or equal to "2" (predetermined value) needs to be changed (S106). As illustrated in FIG. 10, "3" is the differential value of the support against cutting moves, which is greater than or equal to the predetermined value. Thus, the support against cutting moves is a parameter of the footwear functions that needs to be changed. Instead of thus determining that any parameter of the footwear functions with a differential value greater than or equal to the predetermined value needs to be changed, any parameter of the footwear functions may be determined as needing to be changed when its differential value is a minus value and the absolute value of this differential value is greater than or equal to "2" (predetermined value).

Sock liner designing apparatus 1 adjusts the design data of sock liner 1A to change the parameters of these footwear functions (S107). To allow the support against cutting moves of footwear 100, currently "2", to be as close to "5" as possible, as illustrated in FIG. 10, the structure, cup height in each portion and thickness in each portion are adjusted among the design data of sock liner 1A. To ensure better support against cutting moves, sock liner designing apparatus 1 adjusts the design data of sock liner 1A, so that the sock liner is relatively hardened and the lateral cup heights (h1 to h3) are increased, and the lateral thicknesses are slightly increased to prevent footwear 100 from leaning sideways.

Figure 11:
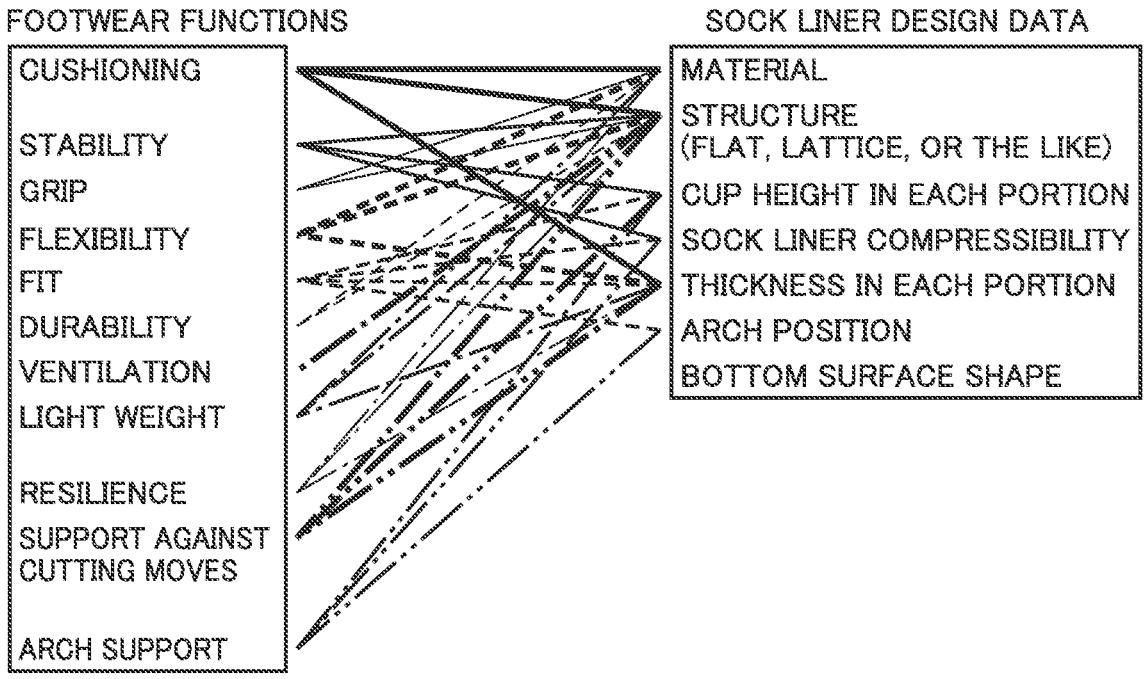
FIG. 11 is a diagram for describing correlation between the sock liner design data and footwear functions.

In storage 13 of sock liner designing apparatus 1 is stored in advance correlation between the design data of sock liner 1A and the parameters of footwear functions, which helps to know which piece of design data needs to be adjusted to change a certain parameter. FIG. 11 is a diagram for describing correlation between the sock liner design data and footwear functions. The correlation illustrated in FIG. 11 is just an example. In order to change the cushioning among the parameters of footwear functions, at least one of the material, structure, and thickness in each portion in the design data of sock liner 1A needs to be adjusted. In order to change the stability among the parameters of footwear functions, at least one of the structure, thickness in each portion and sock liner compressibility, among of design data of sock liner 1A, needs to be adjusted. Sock liner designing apparatus 1 may flexibly set the amount of change of any parameter to be adjusted in view of a user's gender, age, weight, average walking/running speed, average running/walking distance, ground surface, and/or past injury(ies).

Figure 12:
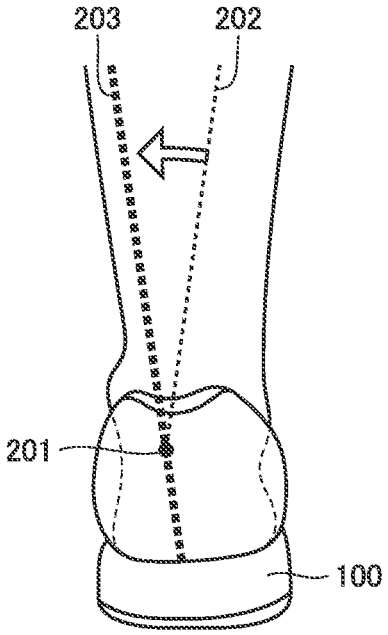
FIG. 12 is a schematic diagram for describing pronation.

Example 2 describes designing, using sock liner designing apparatus 1, sock liner 1A allowed to change the footwear functions in case a user's foot pronation differs from the pronation of footwear 100. FIG. 12 is a schematic diagram for describing the pronation. The pronation refers to a natural motion of human body in which the heel of a foot leans inward at the time of hitting the ground. Specifically describing the pronation, a line 202 extending from a heel 201 before hitting the ground leans inward, like a line 203, under an impact when the foot hits the ground, as illustrated in FIG. 12. There are three groups of pronation classification; overpronation in which line 203 makes a relatively large angle to line 202, neutral pronation in which line 203 makes a modest angle to line 202, and underpronation in which line 203 makes a relatively small angle to line 202. If a user with overpronation feet wears footwear 100 designed for neutral pronation, an excessive burden may be imposed on user's legs and/or knees, or inadequate shock absorption may be likely to invite risks of pain and/or injury.

FIG. 13 is a schematic diagram for describing Example 2, illustrating adjustments of the design data using sock liner designing apparatus 1 according to the embodiment. FIG. 13 describes an example in which sock liner 1A is designed by sock liner designing apparatus 1. In this example, sock liner 1A, when used in footwear 100, is allowed to adjust the functions of footwear 100 designed for neutral pronation, so that footwear 100 are suitably worn by a user who walks/runs with overpronation feet.

First, overpronation footwear functions are received by sock liner designing apparatus 1 as footwear functions desired by a user (S103). As illustrated in FIG. 13, required footwear functions are; "4" for cushioning, "5" for stability, and "3" for arch support. Five grades are defined for the evaluation of footwear functions, ranging from the lowest "1" to the highest "5". Depending on the purpose of use, any irrelevant parameters of the footwear functions are rated as "n/a" and excluded from the criteria of evaluation.

The model number of footwear 100 purchased by the user is inputted to sock liner designing apparatus 1 to read, from storage 13, the footwear data of footwear 100 corresponding to the inputted model number. Then, the read footwear data is received by sock liner designing apparatus 1 (S104). As illustrated in FIG. 13, the received footwear data of footwear 100 is; "5" for cushioning, "3" for stability, and "2" for arch support. As for the footwear data of footwear 100, values of evaluation have been inputted to all of the parameters as illustrated in FIG. 13, which are not necessarily limited to the use of this example.

The differential values between the required footwear functions and the footwear data of footwear 100 are calculated by sock liner designing apparatus 1 (S105). As illustrated in FIG. 13, the calculated differential values are; "−1" for cushioning, "2" for stability, and "1" for arch support. Sock liner designing apparatus 1 determines that any parameter of the footwear functions with a differential value greater than or equal to "2" (predetermined value) needs to be changed (S106). As illustrated in FIG. 13, "2" is the differential value in regard to stability, which is greater than or equal to the predetermined value. Thus, the stability is determined as a parameter of footwear functions that needs to be changed.

Sock liner designing apparatus 1 adjusts the design data of sock liner 1A to change the parameters of these footwear functions (S107). To allow the stability of footwear 100, currently "3", to be as close to "5" as possible, as illustrated in FIG. 13, the structure, cup height in each portion, and sock liner compressibility are adjusted among the design data of sock liner 1A. To prevent the heel from leaning inward when the foot hits the ground, sock liner designing apparatus 1 adjusts the design data of sock liner 1A so that the medial structure is relatively hardened, the cup height of the medial arch (h5) is increased, and the sock liner compressibility on the medial side is slightly increased. Sock liner designing apparatus 1 may flexibly set the amount of change of any parameter to be adjusted in view of a user's gender, age, weight, average walking/running speed, average running/walking distance, ground surface, and/or past injury(ies).

Figure 14:
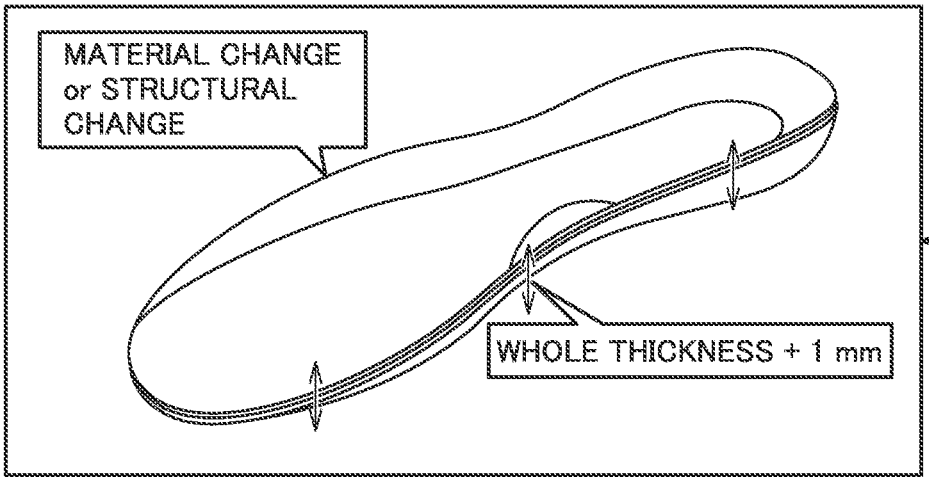
FIG. 14 is a schematic diagram for describing Example 3, illustrating adjustments of design data using the sock liner designing apparatus according to the embodiment.

Next, Example 3 describes an example in which sock liner 1A that allows footwear functions to be changed by sock liner designing apparatus 1 incase footwear 100 purchased by a user for day-to-day running practice are athletic footwear that are overengineered for the user. FIG. 14 is a schematic diagram for describing Example 3, illustrating adjustments of the design data using sock liner designing apparatus 1 according to the embodiment. First, footwear functions for running purpose are received by sock liner designing apparatus 1 as footwear functions desired by a user (S103). As illustrated in FIG. 14, the required footwear functions are; "4" for cushioning, "3" for stability, "3" for grip, "4" for flexibility, "3" for fit, "3" for durability, "4" for ventilation, "3" for light weight, "3" for resilience, and "4" for arch support. Five grades are defined for the evaluation of footwear functions, ranging from the lowest "1" to the highest "5". Depending on the purpose of use, any irrelevant parameters of the footwear functions are rated as "n/a" and excluded from the criteria of evaluation.

The model number of footwear 100 purchased by the user is inputted to sock liner designing apparatus 1 to read, from storage 13, the footwear data of footwear 100 corresponding to the inputted model number. Then, the read footwear data is received by sock liner designing apparatus 1 (S104). As illustrated in FIG. 14, the received footwear data of footwear 100 are; "2" for cushioning, "2" for stability, "4" for grip, "4" for flexibility, "3" for fit, "2" for durability, "5" for ventilation, "5" for light weight, "4" for resilience, and "3" for arch support. Among the footwear data of footwear 100 designed for running purpose, the support against cutting moves is rated as "n/a" and excluded from the criteria of evaluation.

The differential values between the required footwear functions and the footwear data of footwear 100 are calculated by sock liner designing apparatus 1 (S105). As illustrated in FIG. 14, the calculated differential values are; "2" for cushioning, "1" for stability, "−1" for grip, "0" for flexibility, "0" for fit, "1" for durability, "−1" for ventilation, "−2" for light weight, "−1" for resilience, and "1" for arch support. Sock liner designing apparatus 1 determines that any parameter of the footwear functions with a differential value greater than or equal to "2" (predetermined value) needs to be changed (S106). As illustrated in FIG. 14, "2" is the differential value in regard to cushioning, which is greater than or equal to the predetermined value. Thus, the cushioning is determined as a parameter of footwear functions that needs to be changed.

Sock liner designing apparatus 1 adjusts the design data of sock liner 1A to change the parameters of these footwear functions (S107). To allow the cushioning of footwear 100, currently "2", to be as close to "4" as possible, as illustrated in FIG. 14, the material, structure and thickness in each portion are adjusted among the design data of sock liner 1A. For better cushioning, sock liner designing apparatus 1 may adjust the design data of sock liner 1A, for example, select a more elastic material, employ a lattice structure, and/or increase the whole thickness by 1 mm. The light weight has a minus differential value and the absolute value of this differential value is greater than or equal to "2" (predetermined value). This, therefore, may be determined as a parameter of footwear functions that needs to be changed. In this instance, the material, structure, and thickness in each portion, among the design data of sock liner 1A, may be further adjusted. Sock liner designing apparatus 1 may flexibly set the amount of change of any parameter to be adjusted in view of a user's gender, age, weight, average walking/running speed, average running/walking distance, ground surface, and/or past injury(ies).

Example 4 describes designing, using sock liner designing apparatus 1, sock liner 1A allowed to change the footwear functions of footwear 100 in case a user wants to further enhance the footwear functions selected earlier by the user. FIG. 15 is a schematic diagram for describing Example 4, illustrating adjustments of the design data using sock liner designing apparatus 1 according to the embodiment. First, footwear functions selected by a user are received by sock liner designing apparatus 1 as footwear functions desired by the user (S103). As illustrated in FIG. 15, required footwear functions are; "5" for cushioning, and "5" for stability. Five grades are defined for the evaluation of footwear functions, ranging from the lowest "1" to the highest "5". Any parameters not selected by the user are rated as irrelevant parameter "n/a" and excluded from the criteria of evaluation.

The model number of footwear 100 purchased by the user is inputted to sock liner designing apparatus 1 to read, from storage 13, the footwear data of footwear 100 corresponding to the inputted model number. Then, the read footwear data is received by sock liner designing apparatus 1 (S104). As illustrated in FIG. 15, the received footwear data of footwear 100 are; "4" for cushioning, "3" for stability, "3" for grip, "4" for flexibility, "3" for fit, "3" for durability, "4" for ventilation, "3" for light weight, "3" for resilience, "4" for arch support, and "2" for support against cutting moves.

The differential values between the required footwear functions and the footwear data of footwear 100 are calculated by sock liner designing apparatus 1 (S105). As illustrated in FIG. 15, the calculated differential values are; "1" for cushioning, and "2" for stability. In FIG. 15, the parameters of footwear functions selected by the user are illustrated with hatched lines. Sock liner designing apparatus 1 determines that any parameter of the footwear functions having a differential value greater than or equal to "1" (predetermined value) needs to be changed (S106). As illustrated in FIG. 15, the differential values are; "1" for cushioning and "2" for stability, which are greater than or equal to a predetermined value. Thus, these are determined as parameters of footwear functions that need to be changed.

Sock liner designing apparatus 1 adjusts the design data of sock liner 1A to change the parameters of these footwear functions (S107). To allow the cushioning of footwear 100, currently "4", to be as close to "5" as possible, as illustrated in FIG. 15, the material, structure, and thickness in each portion are adjusted among the design data of sock liner 1A. To allow the stability of footwear 100, currently "3", to be as close to "5" as possible, the structure, thickness in each portion, and sock liner compressibility are adjusted among the design data of sock liner 1A. To improve the cushioning, sock liner designing apparatus 1 may adjust the design data of sock liner 1A, for example, select a more elastic material, employ a lattice structure, and/or increase the whole thickness by 1 mm. For better stability, sock liner designing apparatus 1 may further adjust the design data of sock liner 1A, for example, increase the cup height of the medial arch (h5) and/or change the sock liner compressibility from 60% to 70%. Sock liner designing apparatus 1 may flexibly set the amount of change of any parameter to be adjusted in view of a user's gender, age, weight, average walking/running speed, average running/walking distance, ground surface, and/or past injury(ies).

With reference to FIG. 9 again, in case all of the parameters of footwear functions having differential values greater than or equal to the predetermined value are adjusted, sock liner designing apparatus 1 determines that no parameter of footwear functions is greater than or equal to the predetermined value (NO in S106) and then outputs the adjusted design data of sock liner 1A to 3D printer 3 (or NC working machine) (S108). Then, 3D printer 3 (or NC working machine) produces sock liner 1A based on the adjusted design data of sock liner 1A to allow footwear 100 mounted with this sock liner 1A to have footwear functions most approximate to those desired by the user.

[Prediction of User's Foot Shape]

In S102 illustrated in FIG. 9, sock liner designing apparatus 1 generates the design data of sock liner 1A based on the foot data received in S101. The foot data received in S101 was measured by laser measuring unit 22 with a load being imposed on a subject's (user's) foot. To obtain sock liner 1A that can adapt to the foot shape, however, foot data is desirably obtained in an unloaded state in which the foot shape is unaffected by any load. Sock liner designing apparatus 1 may be allowed to predict a subject's load-free foot shape to obtain more easily the subject's foot data in the unloaded state.

Figure 16:
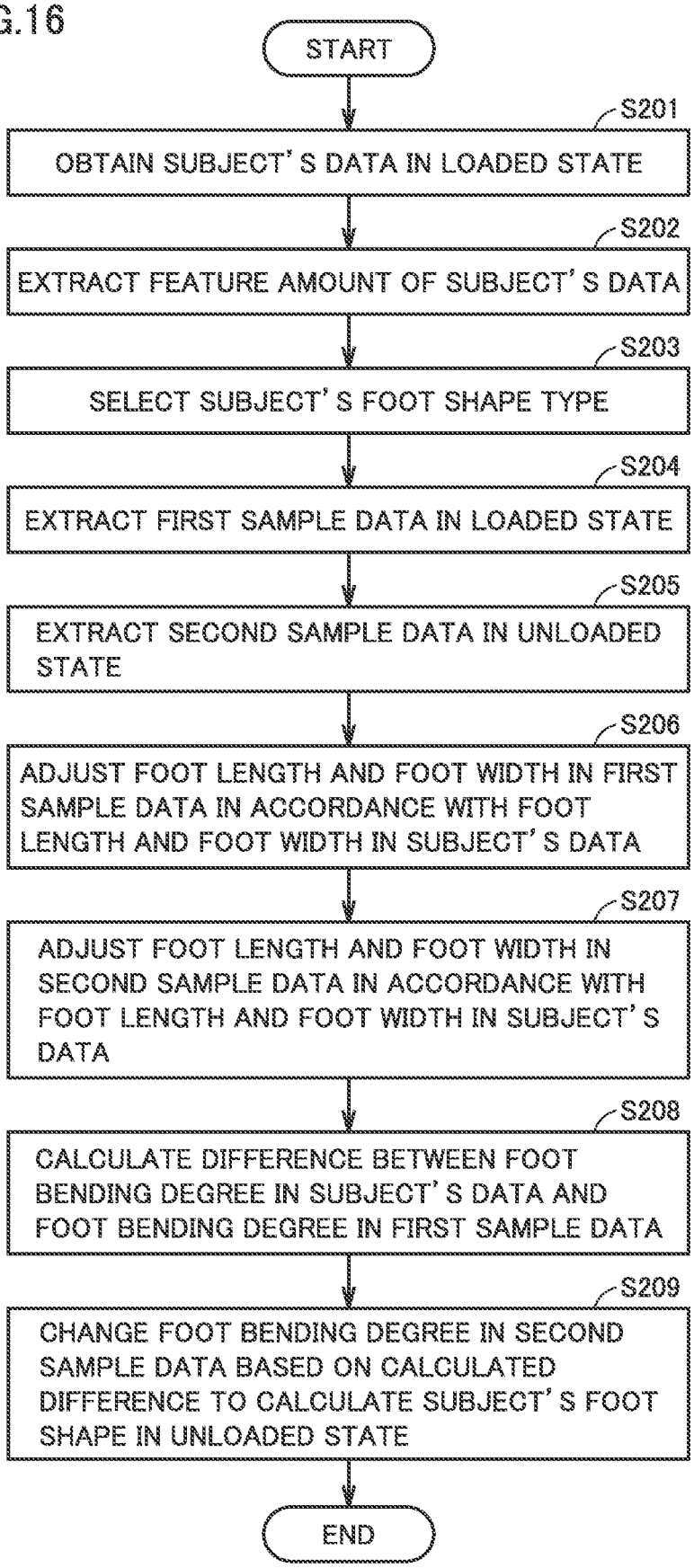
FIG. 16 is a flow chart of a prediction process carried out to predict an unloaded state foot shape of a subject.
Figure 19:
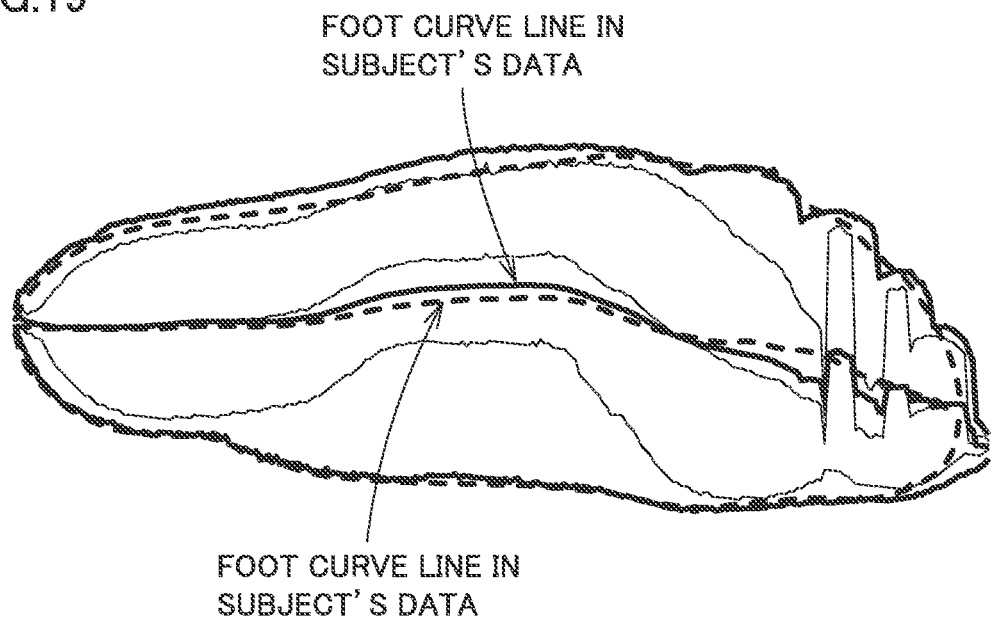
FIG. 19 is a diagram for describing calculation of a difference between a subject's data and first sample data.

With reference to FIGS. 16 to 19, the prediction process carried out by sock liner designing apparatus 1 to predict the subject's foot shape in the unloaded state is hereinafter described. FIG. 16 is a flow chart of a prediction process carried out to predict a subject's foot shape in an unloaded state. FIG. 17 is a table showing an example of loaded foot shape data. FIG. 18 is a table showing an example of unloaded foot shape data. FIG. 19 is a diagram for describing calculation of a difference between a subject's data and first sample data. Steps illustrated in FIG. 16 (step numbers starting with "S") are carried out by having prediction program 131 run by processor 11 of sock liner designing apparatus 1.

As illustrated in FIG. 16, sock liner designing apparatus 1 obtains the subject's data containing subject's foot shape data in the loaded state measured by measuring apparatus 2 (foot data) (S201). Sock liner designing apparatus 1 produces a homology model based on the subject's data and extracts feature amounts of the subject's data (in this example, arch height ratio, heel leaning angle) (S202). Sock liner designing apparatus 1 selects the subject's foot shape type based on the feature amounts of the subject's data (S203). Sock liner designing apparatus 1 selects one of foot shape types illustrated in FIG. 17 classified based on degrees of the subject's foot arch and heel leaning type.

Sock liner designing apparatus 1 extracts, from loaded foot shape data 133 stored in storage 13, first sample data in the loaded state that can adapt to the subject's foot shape type selected in S203 (S204). The first sample data thus extracted contains an average foot shape data in the loaded state that can adapt to the subject's foot shape type (homology model).

As illustrated in FIG. 17, the loaded foot shape data includes pieces of data obtained by classifying, for each of foot shape types foot shape, measured data of a plurality of samples in the loaded state (to be specific, homology model produced based on the measured data) based on at least one feature amount associated with foot shapes. In the example of FIG. 17, the arch height ratio and heel leaning angle (angle through which the heel leans inward) are used as at least one feature amount. Then, the loaded foot shape data is divided into nine different foot shape types according to three different arch types classified as per arch height ratio and three heel leaning types classified as per heel leaning angle.

Sock liner designing apparatus 1 extracts, from unloaded foot shape data 134 stored in storage 13, second sample data in the unloaded state that can adapt to the subject's foot shape type selected in S203 (S5). The second sample data thus extracted includes an average foot shape data (homology model) in the unloaded state that can adapt to the subject's foot shape type.

As illustrated in FIG. 18, the unloaded foot shape data includes pieces of data obtained by classifying, for each of different foot shape types, measured foot shape data of a plurality of samples in the unloaded state (to be specific, homology model produced based on the measured data) based on at least one foot shape-related feature amount. In the example of FIG. 18, the arch height ratio and heel leaning angle are used as at least one feature amount. Then, the unloaded foot shape data is divided into nine different foot shape types according to three different arch types classified as per arch height ratio and three heel leaning types classified as per heel leaning angle.

Sock liner designing apparatus 1 adjusts the foot length and orthogonal foot width of the first sample data in the loaded state extracted in S204 to be equal to the foot length and orthogonal foot width of the homology model produced based on the subject's data (S206). Thus, the curve line of an average foot in the loaded state corresponding to the first sample data is changed in accordance with the subject's foot length and orthogonal foot width.

Sock liner designing apparatus 1 adjusts the foot length and orthogonal foot width of the second sample data in the unloaded state extracted in S205 to be equal to the foot length and orthogonal foot width of the homology model produced based on the subject's data (S207). Thus, the curve line of an average foot in the unloaded state corresponding to the second sample data is changed in accordance with the subject's foot length and orthogonal foot width.

Sock liner designing apparatus 1 calculates the foot curve line based on the subject's data and the first sample data changed in S206 and compares the foot curve line in the subject's data with the foot curve line in the loaded state corresponding to the first sample data changed in S206 to calculate a difference between these foot curve lines (S208).

More specifically, sock liner designing apparatus 1 compares the foot curve line in the subject's data illustrated with a solid line and the foot curve line in the loaded state corresponding to the first sample data illustrated with a dotted line to calculate a difference between these two curve lines in the direction of foot length, as illustrated in FIG. 19.

The foot curve line of the subject's data and the foot curve line of the first sample data in the loaded state only need to be calculated from the foot's sole shape obtained by measuring apparatus 2. More specifically, a contour line, medial ground contact line and lateral ground contact line may be determinable even in the loaded state. Therefore, the foot curve line of the subject's data and the foot curve line of the first sample data in the loaded state only need to be calculated based on the contour line, medial ground contact line and lateral ground contact line. The foot curve line of the second sample data in the unloaded state may be used instead of the foot curve line of the first sample data. For instance, the medial ground contact line and lateral ground contact line may be calculated using a point of intersection of a line passing through at a certain height from a lowest line with an outer shape on the medial or lateral side of foot, the foot curve line of the second sample data may be calculated using the calculated medial ground contact line and lateral ground contact line, so that the curve line thus calculated is used as the foot curve line of the first sample data.

Sock liner designing apparatus 1 changes the degree of foot bending (curve line) in the unloaded state corresponding to the second sample data adjusted in S206 based on the calculated curve difference to calculate the subject's foot shape (homology model) in the unloaded state (S209). Then, sock liner designing apparatus 1 ends this process.

Specifically, in sock liner designing apparatus 1, a plurality of component points along and constituting the foot's outer shape in cross section in the second sample data are shifted in a direction in which the difference calculated in S208 can be cancelled. More specifically, in sock liner designing apparatus 1, a plurality of component points along and constituting the foot's outer shape in cross section in the second sample data are shifted so that the foot curve line in the second sample data is coincident with the foot curve line in the subject's data. Sock liner designing apparatus 1 thus shifts these component points constituting the foot's outer shape at predetermined intervals (for example, at the intervals of 1 mm) along the direction of foot length.

Thus, sock liner designing apparatus 1 is allowed to calculate the subject's foot shape data in the unloaded state (homology model) from data of the subject's foot shape measured in the loaded state obtained by measuring apparatus 2.

MODIFIED EXAMPLE

The present disclosure may encompass, in its scope, variously different modifications. Modified examples applicable to the technology disclosed herein are described below.

As illustrated in FIG. 9, sock liner designing apparatus 1 according to the embodiment determines whether any parameter of footwear functions needs to be changed based on whether any difference between the received footwear functions (first function parameter) and footwear data (second function parameter) is greater than or equal to a predetermined value.

Sock liner designing apparatus 1 may otherwise determine whether any parameter of footwear functions needs to be changed. For example, the apparatus may multiply, by a coefficient, any difference between the received footwear functions (first function parameter) and footwear data (second function parameter) and then compare the resulting value with a predetermined value, or may execute a computing process by assigning the difference to a predetermined function.

Sock liner designing apparatus 1 may be installed in a store or shop equipped with measuring apparatus 2 or may be a cloud-based server device. Sock liner designing apparatus 1, if it is a cloud-based server device, may be connected to measuring apparatuses 2 installed in stores and shops and generate the design data of sock liner 1A based on pieces of foot shape data obtained from these measuring apparatuses 2.

ASPECTS (1) A sock liner designing apparatus according to the present disclosure is a sock liner designing apparatus for use in designing a sock liner for footwear, the sock liner designing apparatus including: an input circuitry that receives an input of foot data measured; a computer that calculates design data of the sock liner based on the foot data received through the input circuitry; and an output circuitry that outputs the design data calculated by the computer, in which the input circuitry further receives an input of a first function parameter and an input of a second function parameter, the first function parameter indicating functions of the footwear desired by a user, and the second function parameter indicating functions of the footwear selected by the user, and the computer adjusts the design data based on a difference between the first function parameter and the second function parameter received through the input circuitry.

The sock liner designing apparatus thus characterized adjusts the design data based on the difference between the first function parameter and the second function parameter received through the input circuitry. Thus, this apparatus may design sock liners that can attain functions of footwear desired by a user when the user wears footwear.

(2) In the sock liner designing apparatus according to (1), the first function parameter and the second function parameter include at least one of: cushioning, stability, grip, flexibility, fit, durability, ventilation, light weight, resilience, support against cutting moves and arch support. Thus, the footwear may certainly satisfy functions desired by a user.

(3) In the sock liner designing apparatus according to (1) or (2), the design data includes at least one of: material, structure, cup height in each portion, sock liner compressibility, thickness in each portion, arch position, and bottom surface shape. Thus, the sock liner design data may be flexibly adjustable depending on the footwear functions.

(4) In the sock liner designing apparatus according to any one of (1) to (3), the computer adjusts the design data, so that the second function parameter having a difference greater than or equal to a predetermined value relative to the first function parameter is changed to have a value more approximate to the first function parameter. This may allow the sock liner to attain functions of footwear desired by a user when this sock liner is used in the footwear.

(5) In the sock liner designing apparatus according to any one of (1) to (3), the computer adjusts the design data, so that the second function parameter has a value greater than or equal to the first function parameter selected by a user. Thus, the sock liner, when used in footwear, may improve functions desired of the footwear by a user.

(6) In the sock liner designing apparatus according to any one of (1) to (5), the computer predicts a foot shape of the user in an unloaded state from the foot data to calculate the design data of the sock liner based on the foot shape predicted. Thus, the sock liner adapted to the user's foot shape in the unloaded state may be designed.

(7) The sock liner designing apparatus according to (6) further includes a storage in which first sample data in a loaded state and second sample data in the unloaded state are stored, the first sample data and the second sample data being calculated from measured data of foot shapes of a plurality of samples obtained from a subject in the loaded state and in the unloaded state, in which the computer calculates a difference between the foot data and the first sample data and predicts the foot shape of the user in the unloaded state based on the difference calculated and the second sample data. Thus, a user's foot shape in the unloaded state may be easily predictable.

(8) A sock liner designing method according to the present disclosure is a sock liner designing method for use in designing a sock liner for footwear, the method including: receiving an input of foot data measured; receiving an input of a first function parameter that indicates functions of the footwear desired by a user; receiving an input of a second function parameter that indicates functions of the footwear selected by the user; calculating design data of the sock liner based on the foot data received earlier; adjusting the design data based on a difference between the first function parameter and the second function parameter; and outputting the design data thus adjusted. The sock liner designing method thus characterized adjusts the design data based on the difference between the first function parameter and the second function parameter received earlier. This method may design sock liners that can attain functions of footwear desired by a user when the user wears footwear.

All of the embodiments of the present disclosure are described herein by way of illustration and example only and should not be construed as limiting by any means the scope of the present disclosure. The scope of the present disclosure is solely defined by the appended claims and is intended to cover the claims, equivalents, and all of possible modifications made without departing the scope of the present disclosure.

What is claimed is:

1. A sock liner designing apparatus for use in designing a sock liner for a footwear including a sole and an upper, the sock liner designing apparatus comprising:

a processor configured to:

obtain measurement data of a foot, a first function parameter of a function of the footwear to be improved by insertion of the sock liner into the footwear, and a second function parameter of the function of the footwear, determine a difference between the first function parameter and the second function parameter, the difference between the first function parameter and the second function parameter indicating a deficiency of the function to be improved in the footwear, calculate design data of the sock liner based on the difference between the first function parameter and the second function parameter and the measurement data of the foot, the design data of the sock liner indicating a configuration of the sock liner adapted to improve the function of the footwear for the foot; and output the design data to a three-dimensional (3D) printer or an NC working machine to produce the sock liner having the configuration adapted to improve the function of the footwear for the foot.

2. The sock liner designing apparatus according to claim 1, wherein the first function parameter of the footwear and the second function parameter of the footwear include at least one of:

a cushioning of the footwear;
a stability of the footwear;
a grip of the footwear;
a flexibility of the footwear;
a fit of the footwear;
a durability of the footwear;
a ventilation of the footwear;
a weight of the footwear;
a resilience of the footwear;
a support against cutting moves of the footwear; and
an arch support of the footwear.

3. The sock liner designing apparatus according to claim 1, wherein the configuration of the sock liner includes at least one of:

a material of the sock liner;
a structure of the sock liner;
a cup height in each portion of the sock liner;
a compressibility of the sock liner;
a thickness in each portion of the sock liner;
an arch position of the sock liner; and
a bottom surface shape of the sock liner.

4. The sock liner designing apparatus according to claim 1, wherein the measurement data of the foot includes measurement data of the foot in a loaded state, and the processor is configured to:

determine a foot shape of the foot in an unloaded state from the measurement data of the foot, and calculate the design data of the sock liner based on the foot shape of the foot in the unloaded state.

5. The sock liner designing apparatus according to claim 4, further comprising:

a memory configured to store first sample data of a first plurality of samples of feet in the loaded state and second sample data of a second plurality of samples of feet in the unloaded state, wherein the processor is configured to:

calculate a difference between the measurement data of the foot and the first sample data, and determine the foot shape of the foot in the unloaded state based on the difference between the measurement data of the foot and the first sample data and the second sample data.

6. The sock liner designing apparatus according to claim 2, wherein the configuration of the sock liner includes at least one of:

a material of the sock liner;
a structure of the sock liner;
a cup height in each portion of the sock liner;
a compressibility of the sock liner;
a thickness in each portion of the sock liner;
an arch position of the sock liner; and
a bottom surface shape of the sock liner.

7. The sock liner designing apparatus according to claim 2, wherein the processor is configured to:

determine a foot shape of the foot in an unloaded state from the measurement data of the foot, and calculate the design data of the sock liner based on the foot shape of the foot in the unloaded state.

8. The sock liner designing apparatus according to claim 7, further comprising:

a memory configured to store first sample data of a first plurality of samples of feet in a loaded state and second sample data of a second plurality of samples of feet in the unloaded state, wherein the processor is configured to:

calculate a difference between the measurement data of the foot and the first sample data, and determine the foot shape of the foot in the unloaded state based on the difference between the measurement data of the foot and the first sample data and the second sample data.

9. A sock liner designing method for use in designing a sock liner for a footwear including a sole and an upper, the sock liner designing method comprising:

obtaining measurement data of a foot;

obtaining a first function parameter of a function of the footwear to be improved by insertion of the sock liner into the footwear; obtaining a second function parameter of the function of the footwear;

determining a difference between the first function parameter and the second function parameter, the difference between the first function parameter and the second function parameter indicating a deficiency of the function to be improved in the footwear;

calculating design data of the sock liner based on the difference between the first function parameter and the second function parameter and the measurement data of the foot, the design data of the sock liner indicating a configuration of the sock liner adapted to improve the function of the footwear for the foot; and outputting the design data to produce the sock liner having the configuration adapted to improve the function of the footwear for the foot.

10. A non-transitory recording medium having recorded thereon a program that is executable by a processor, the program causing the processor to perform a sock liner designing method for use in designing a sock liner for a footwear including a sole and an upper, the sock liner designing method comprising:

obtaining measurement data of a foot;

obtaining a first function parameter of a function of the footwear to be improved by insertion of the sock liner into the footwear; obtaining a second function parameter of the function of the footwear;

determining a difference between the first function parameter and the second function parameter, the difference between the first function parameter and the second function parameter indicating a deficiency of the function to be improved in the footwear;

calculating design data of the sock liner based on the difference between the first function parameter and the second function parameter and the measurement data of the foot, the design data of the sock liner indicating a configuration of the sock liner adapted to improve the function of the footwear for the foot; and outputting the design data to produce the sock liner having the configuration adapted to improve the function of the footwear for the foot.

* * * * *